US007071429B1

(12) United States Patent
Anderson et al.

(10) Patent No.: US 7,071,429 B1
(45) Date of Patent: Jul. 4, 2006

(54) LINEAR ADJUSTMENT OPERATOR FOR PRESSURE CONTROL OF PAINT PUMPS

(76) Inventors: Richard P. Anderson, 13209 Beard Ave. S., Burnsville, MN (US) 55337; Scott R. Carpenter, 14620 Edgewood Rd., Rogers, MN (US) 55374

( * ) Notice: Subject to any disclaimer, the term of this patent is extended or adjusted under 35 U.S.C. 154(b) by 0 days.

(21) Appl. No.: 11/234,350

(22) Filed: Sep. 23, 2005

(51) Int. Cl.
*H01H 3/16* (2006.01)

(52) U.S. Cl. ..... 200/81 R; 200/83 R; 200/81 H; 210/704; 210/738; 210/760; 417/18; 417/403; 417/533

(58) Field of Classification Search ..... 200/83 R, 200/83 J, 83 N–83 W, 81 H, 82 R, 81 R; 417/18–20, 34, 44.9, 223, 234, 319, 362, 417/403–404, 533; 210/704, 712, 718, 652, 210/738, 760, 787
See application file for complete search history.

(56) References Cited

U.S. PATENT DOCUMENTS

| | | | | |
|---|---|---|---|---|
| 5,725,359 | A * | 3/1998 | Dongo et al. | 417/44.9 |
| 5,725,364 | A | 3/1998 | Mirazita | |
| 6,213,739 | B1 * | 4/2001 | Phallen et al. | 417/478 |
| 6,273,686 | B1 * | 8/2001 | Kroell et al. | 417/307 |
| 6,419,456 | B1 * | 7/2002 | Cooper et al. | 417/44.2 |
| 6,773,603 | B1 * | 8/2004 | Moorehead et al. | 210/704 |

* cited by examiner

*Primary Examiner*—K. Lee
(74) *Attorney, Agent, or Firm*—Faegre & Benson, LLP

(57) ABSTRACT

A linear adjustment operator for pressure control of paint pumps including a base, an electrical switch, a linear actuator, a spring biasing the switch towards the actuator and a lever acting on the actuator for repositioning the actuator with the switch positioned within a range of angular positions to set a desired pressure for the pump by the position of the lever. A slide operator in a bezel is coupled to the lever for adjustment by a user, with plastically deformable parts in interengagement between the operator and bezel to retain the setting selected.

17 Claims, 36 Drawing Sheets

LINEAR ADJUSTMENT OPERATOR FOR PRESSURE CONTROL OF PAINT PUMPS

FIELD OF THE INVENTION

The present invention relates to the field of adjustment operators for manually setting a desired value of a process control variable. More particularly, the field of the present invention is a manually positionable operator for setting a desired pressure for a paint pump in a paint spraying system.

BACKGROUND OF THE INVENTION

In the past, adjustment operators for adjusting the desired pressure for a paint spray pump have been rotational, typically with multiple rotations in the range of adjustment. While such adjustment operators have been successful and widely used, the adjustment of such prior art operators was somewhat inconvenient in that they required a user to grasp the operator, rotate the operator, and then release the operator and grasp and rotate the operator multiple times to move through all or a substantial portion of the adjustment range of such a rotational pressure setting operator. Additionally, having multiple rotations in the range of adjustment meant that the visual position of an indicator on the operator did not uniquely identify the pressure setting corresponding to the setting of the operator, since the same position of the indicator corresponded to different pressure settings, depending upon how many revolutions the operator was from the end of the range of travel.

SUMMARY OF THE INVENTION

The present invention overcomes the inconvenience of using and the ambiguity of indicating the pressure setting by providing a linear adjustment operator apparatus for pressure control of a paint pump which has a base, with first and second pivot points and an electrical switch mounted for rotational positioning about the first pivot point within a range of angular positions corresponding to a range of pressures for the pump, the switch being responsive to a pressure sensor for actuating the switch when the pressure sensor advances toward the switch wherein the amount of advance of the pressure sensor is proportional to pump pressure. The apparatus includes a linear actuator movable along an axis offset from the first pivot point and in line with the switch and resilient means such as a spring for biasing the switch in a first direction of rotation about the first pivot point and into contact with the linear actuator such that a change of position of the linear actuator results in a change in position of the switch, and a manually positionable lever mounted for rotation about the second pivot point. The apparatus also includes a lever in contact with the linear actuator for repositioning the linear actuator along the axis when the lever is pivoted about the second pivot point to reposition the switch to set a desired pressure for the pump by manually selecting a desired position for the lever. The apparatus may also include a sliding operator received in a frame or bezel for the convenience of the user in moving the lever.

DETAILED DESCRIPTION

Figure 1:
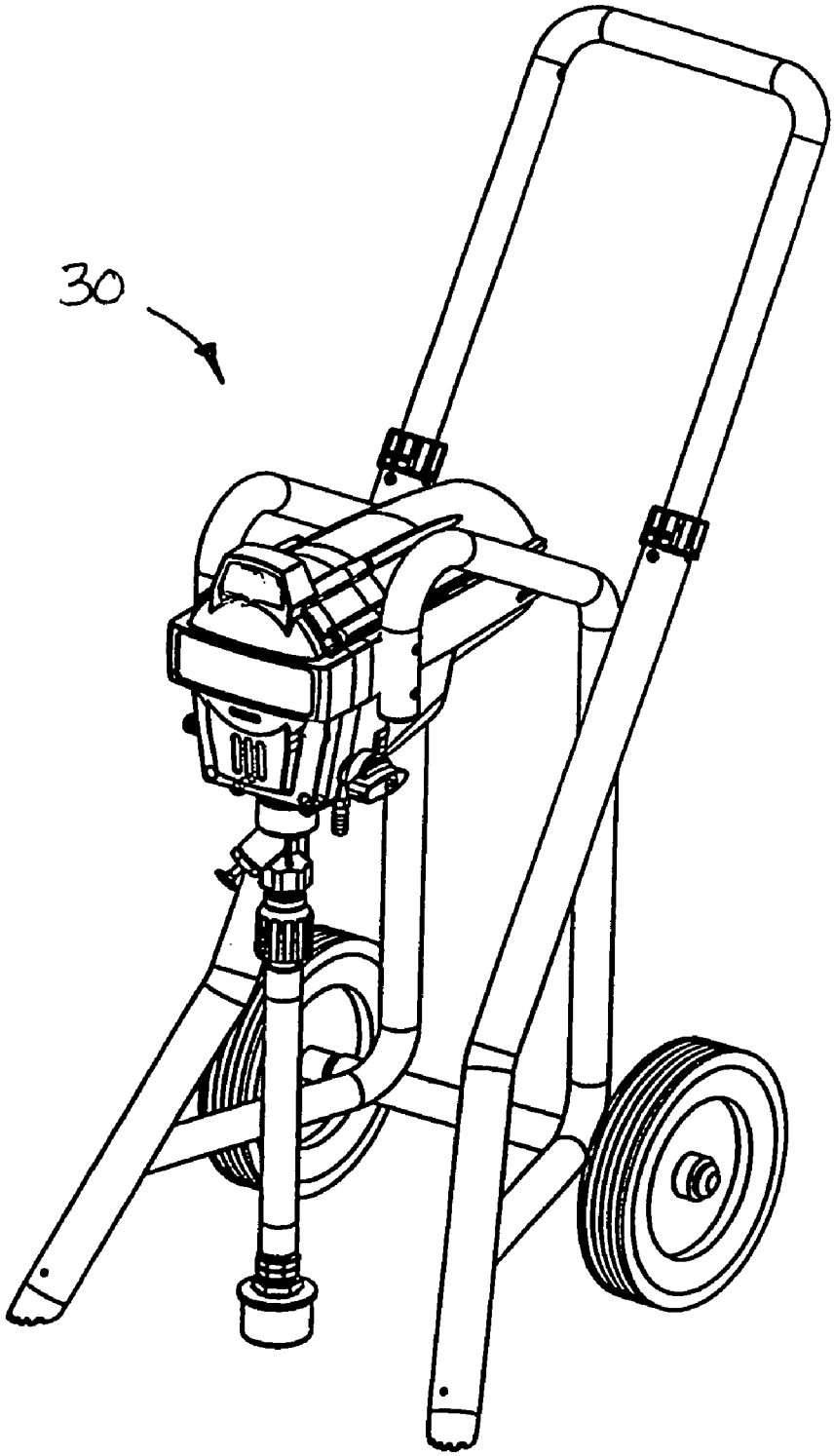
FIG. 1 is a perspective view of a paint pump useful in the practice of the present invention.

Referring to the Figures, and most particularly to FIG. 1, a paint pump and cart 30 of the type to which the present invention is directed may be seen. The paint pump has a pressure sensor similar to that shown in U.S. Pat. No. 5,725,364, the entire contents of which are incorporated herein by reference. The pressure sensor for use with the present invention has a plunger or piston spring biased to a collapsed condition in the absence of pressure. When the pump generates pressure in the paint, the piston extends, acting against the spring, with the amount of extension increasing with increases in pressure. Conversely, when pressure is reduced, the piston retracts. The pressure control for the pump is a switch mechanically biased to a position corresponding to a desired pressure within a range of operating pressures for the pump, with the pump turning ON when the switch senses that paint pressure at the output of the pump has fallen below the set point. After the pump is turned on, ordinarily the pressure will rise in response, because the flow rate at the output of a spray gun or guns fed by the pump will be less than the flow rate delivered by the pump in a properly sized and operating system. Once the pressure reaches the set point the switch will sense the setpoint pressure condition and turn the pump OFF. Typically there will be hysteresis designed in between the ON and OFF set points.

Because of a number of variables in the system, most notably the viscosity of various materials to be delivered by the pump, it is desirable to allow users to adjust the setpoint or desired operating pressure for such paint pumps. The present invention facilitates this by providing a sliding control 32 movable by the user to set pressure, with the added advantage that the position of the sliding control may be observed to determine the pressure setting, at least in a relative manner. Such a sliding control is shown in the side of the pump housing shown in FIG. 2.

Figure 3:
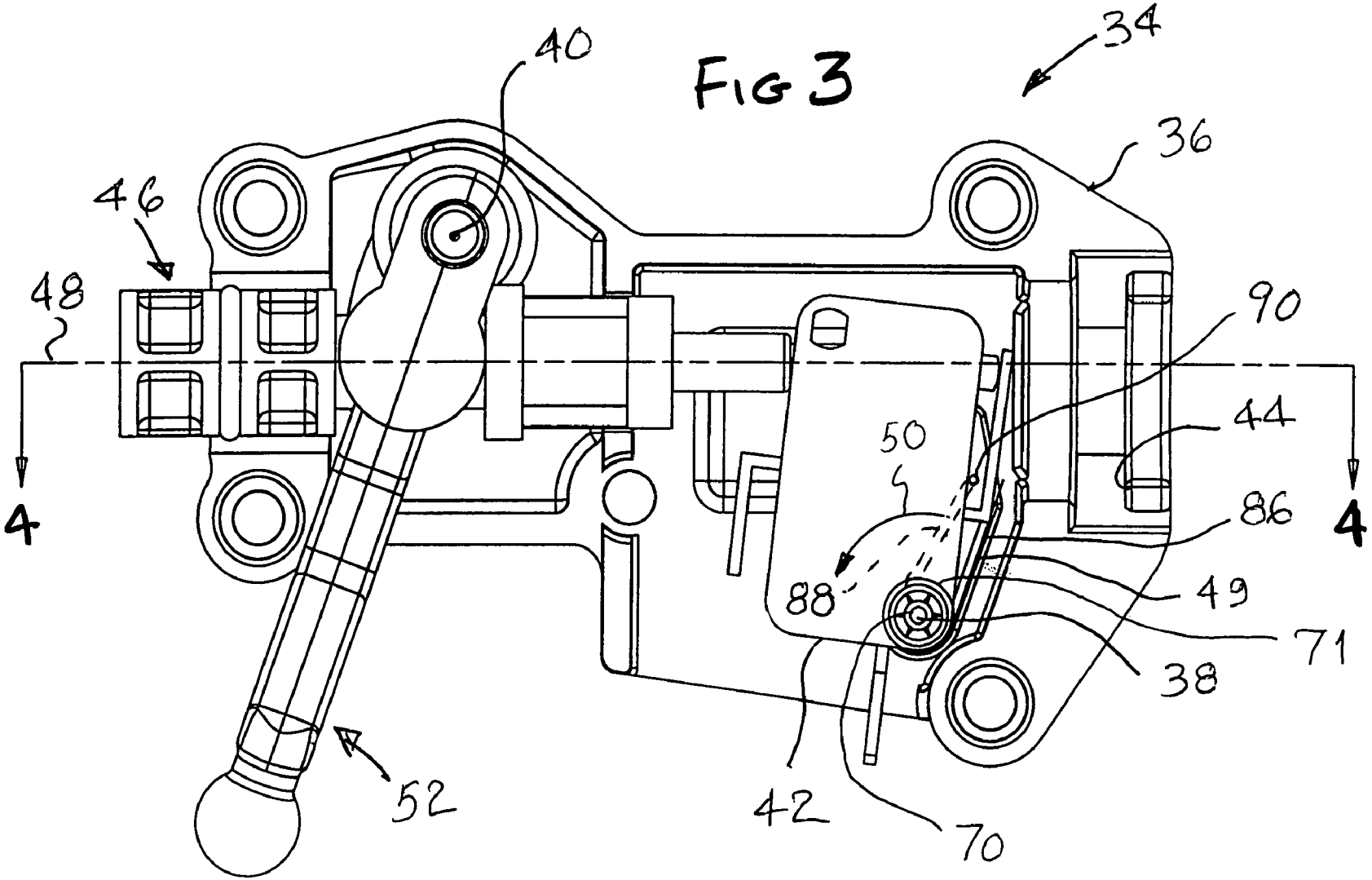
FIG. 3 is a plan view of the linear adjustment operator apparatus in an assembled condition for the practice of the present invention.
Figure 4:
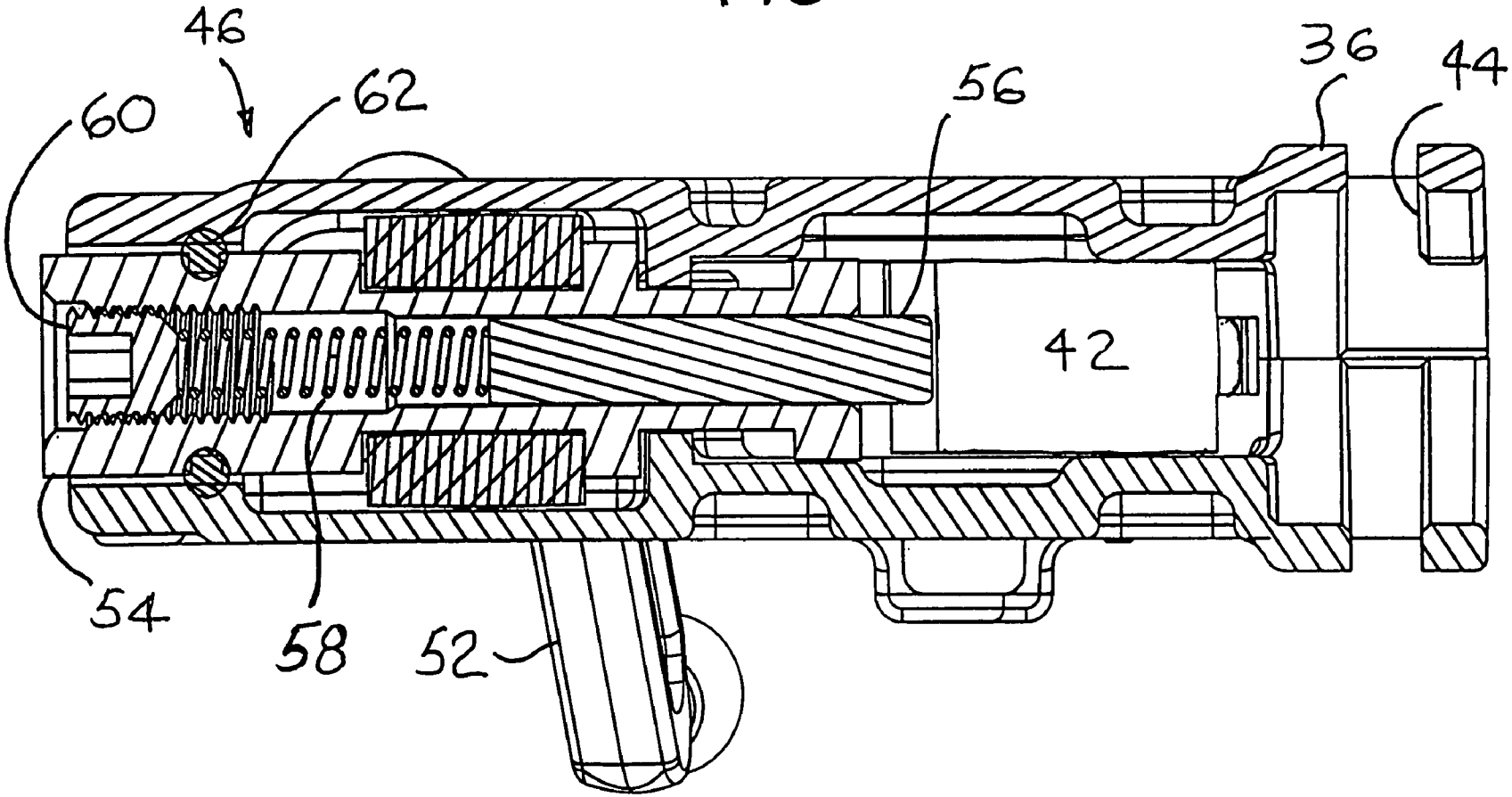
FIG. 4 is a section view of the apparatus of FIG. 3 taken along line 4—4.
Figure 5:
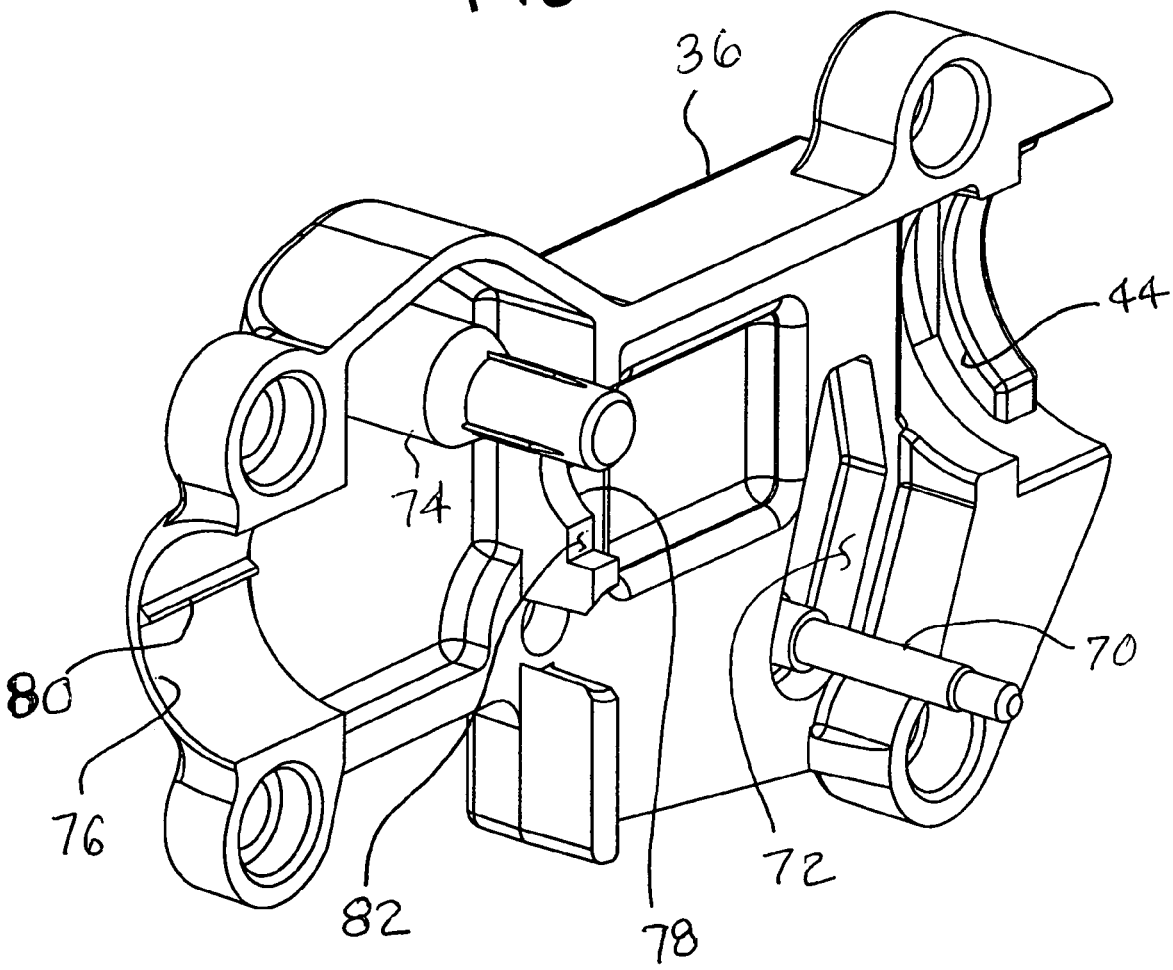
FIG. 5 is a perspective view of a base of the apparatus of FIG. 3.
Figure 6:
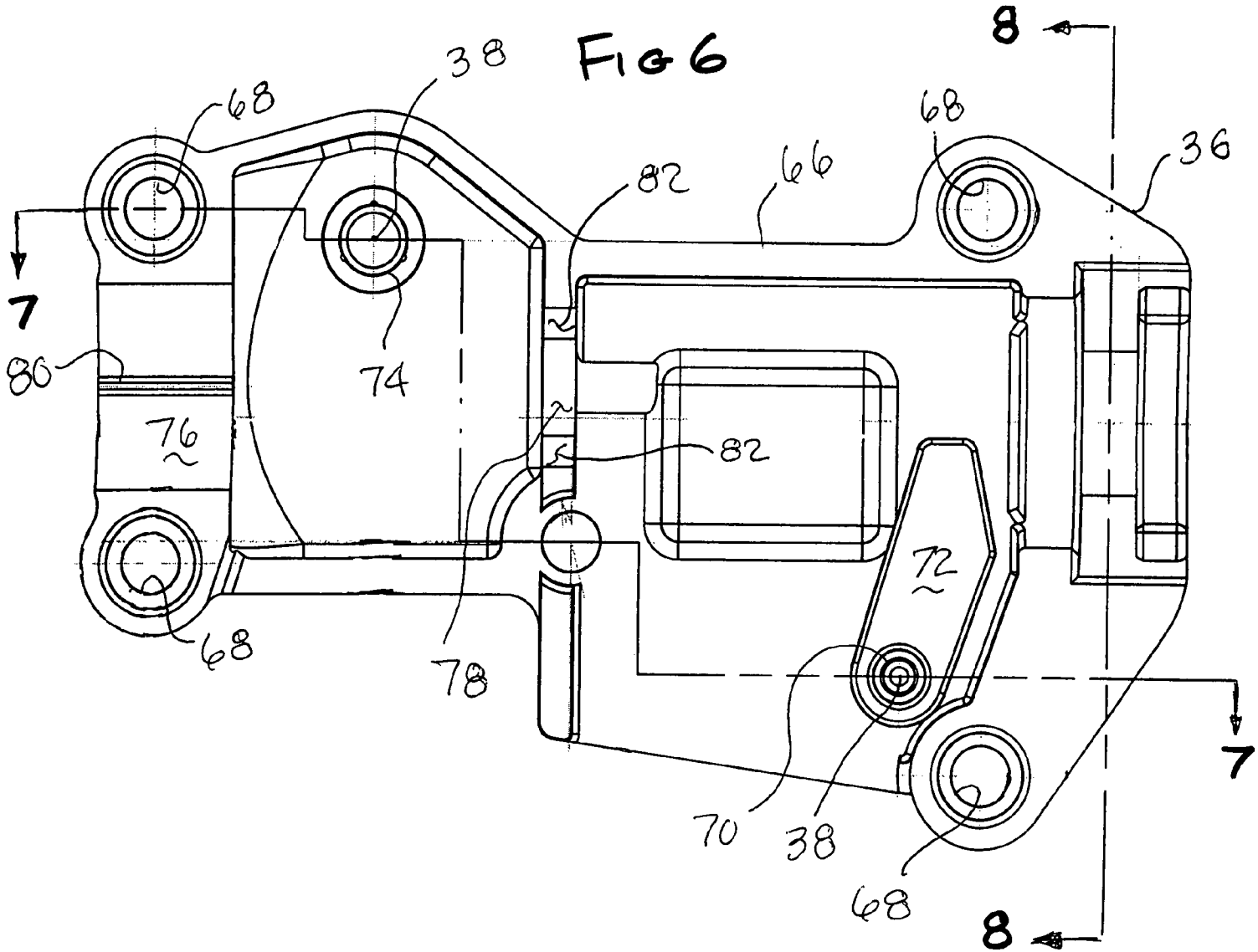
FIG. 6 is a plan view of the base of FIG. 5.
Figure 7:
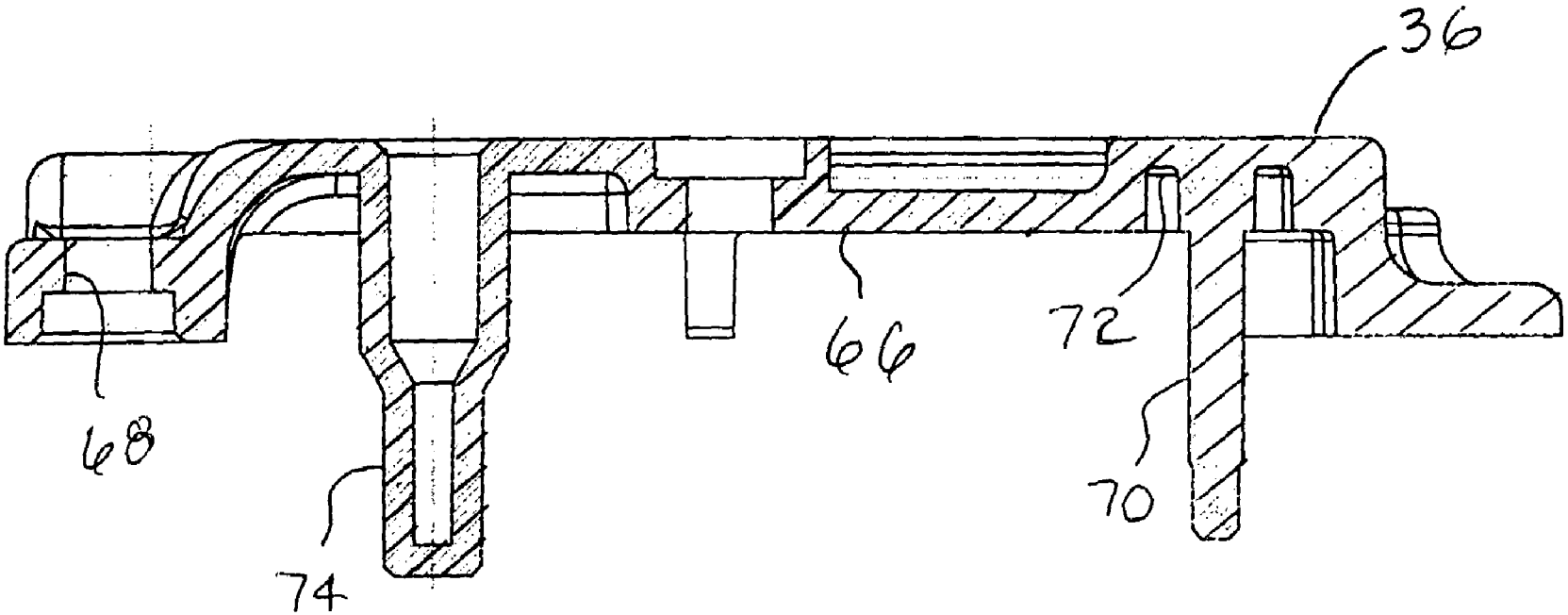
FIG. 7 is a section view of the base taken along line 7—7 of FIG. 6.
Figure 8:
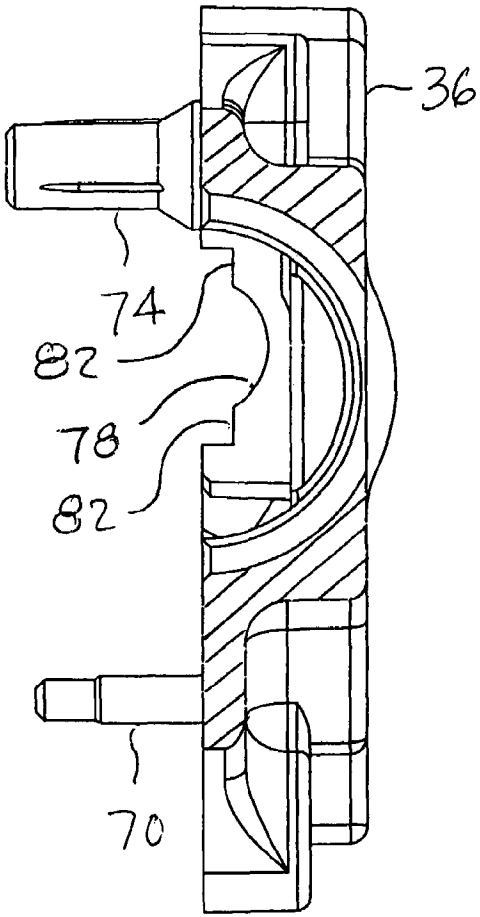
FIG. 8 is a section view of the base taken along line 8—8 of FIG. 6.
Figure 9:
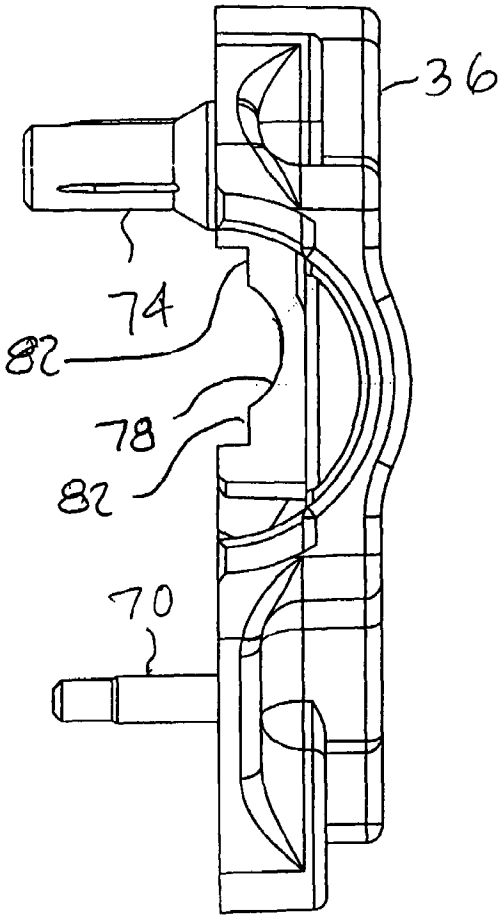
FIG. 9 is a first end view of the base of FIG. 6.
Figure 11:
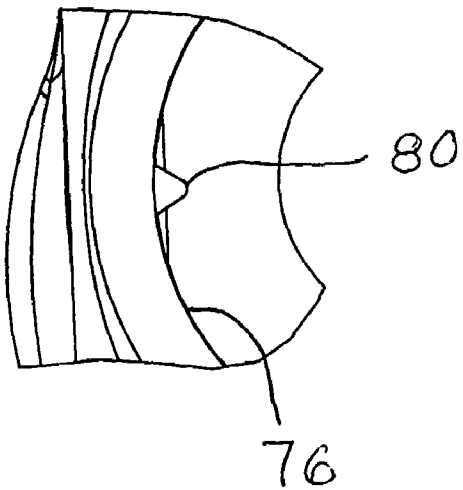
FIG. 11 is an enlarged view of detail 11 of FIG. 10.
Figure 10:
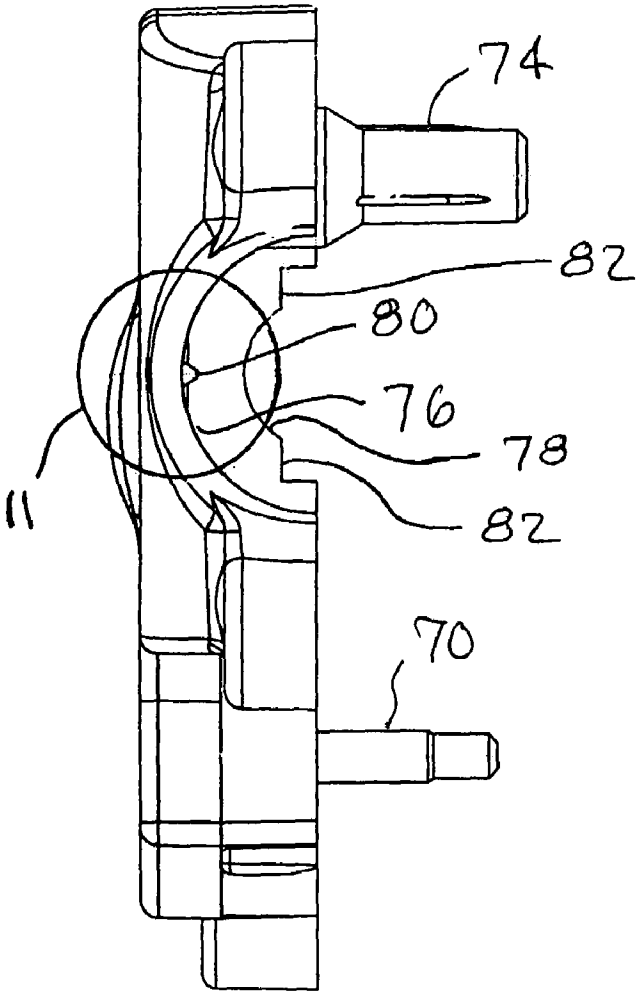
FIG. 10 is a second end view of the base of FIG. 6.
Figure 12:
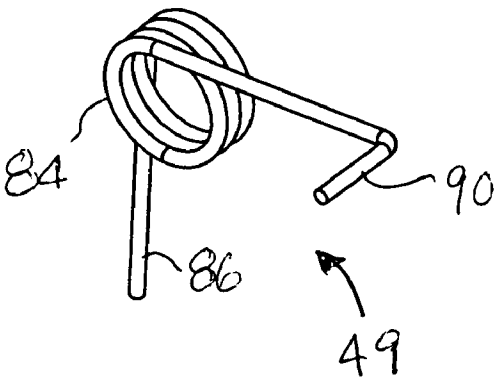
FIG. 12 is a perspective view of a spring useful in the practice of the present invention.
Figure 15:
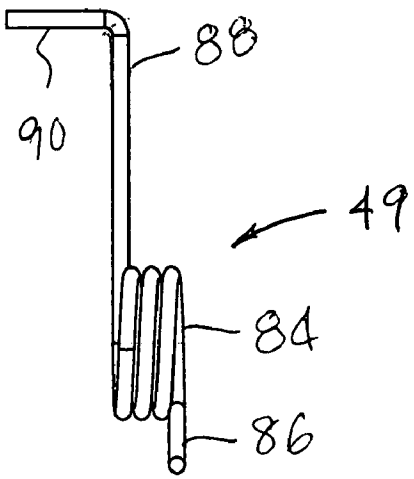
FIG. 15 is an end elevation view of the spring of FIG. 12.
Figure 13:
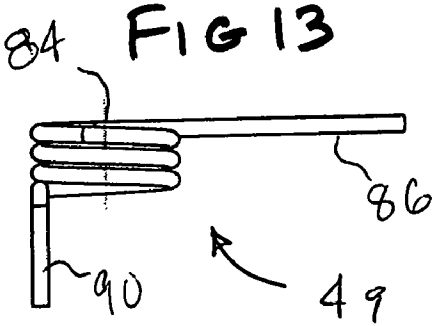
FIG. 13 is a top plan view of the spring of FIG. 12.
Figure 14:
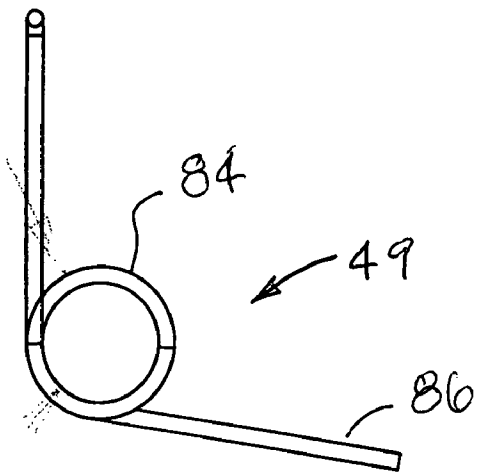
FIG. 14 is a side elevation view of the spring of FIG. 12.
Figure 17:
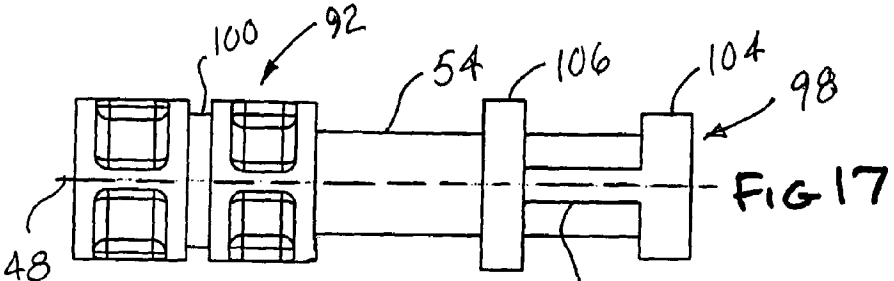
FIG. 17 is a first side view of the linear actuator body of FIG. 16.
Figure 19:
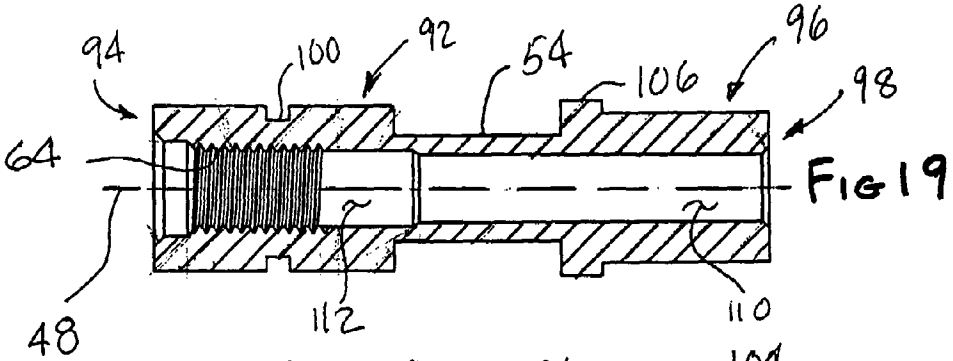
FIG. 19 is a section view taken along line 19—19 of FIG. 18.
Figure 16:
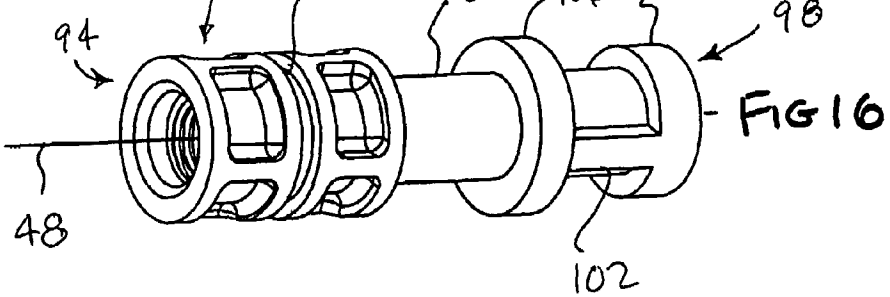
FIG. 16 is a perspective view of a linear actuator body useful in the practice of the present invention.
Figure 18:
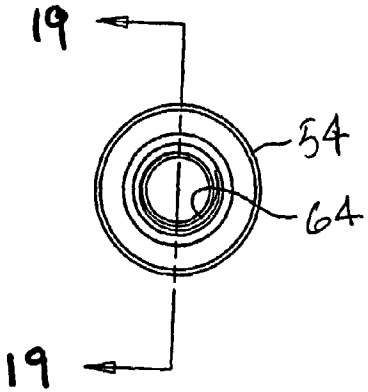
FIG. 18 is an end view of the linear actuator body of FIG. 16.
Figure 23:
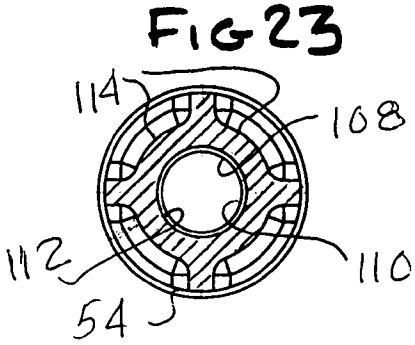
FIG. 23 is a section view taken along line 23—23 of FIG. 20.
Figure 21:
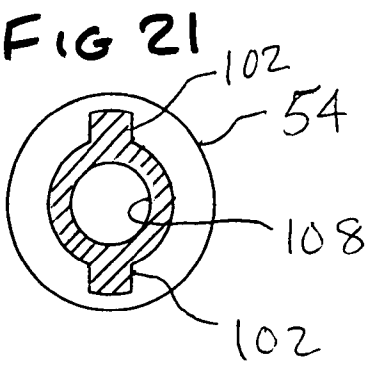
FIG. 21 is a section view taken along line 21—21 of FIG. 20.
Figure 22:
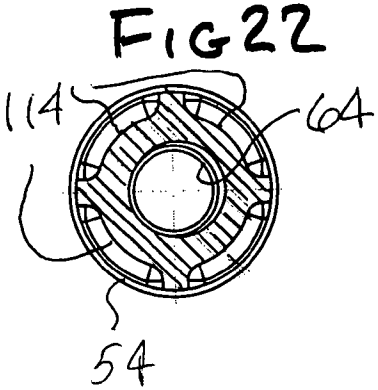
FIG. 22 is a section view taken along line 22—22 of FIG. 20.
Figure 20:
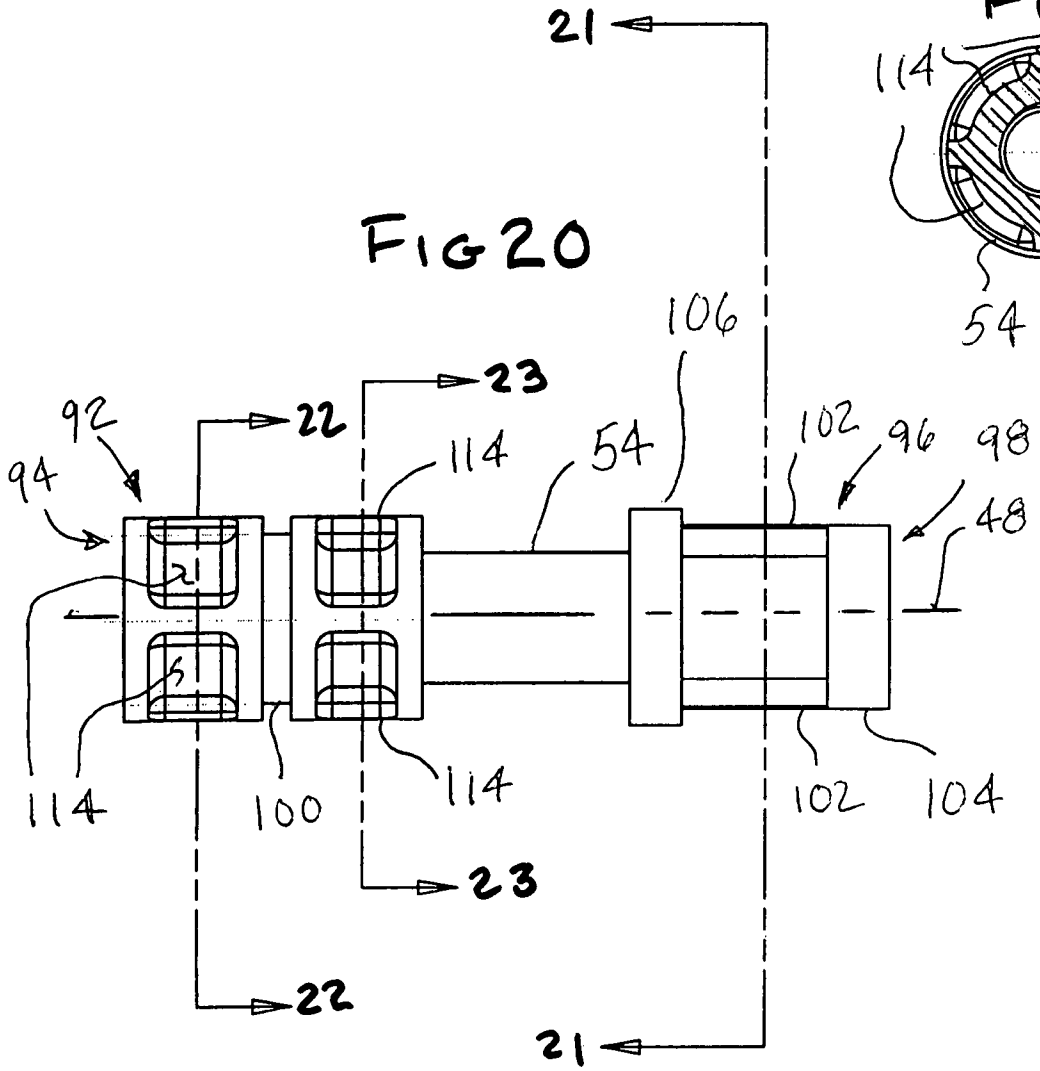
FIG. 20 is a second side view of the linear actuator body of FIG. 16 rotated 90 degrees about its axis.
Figure 24:
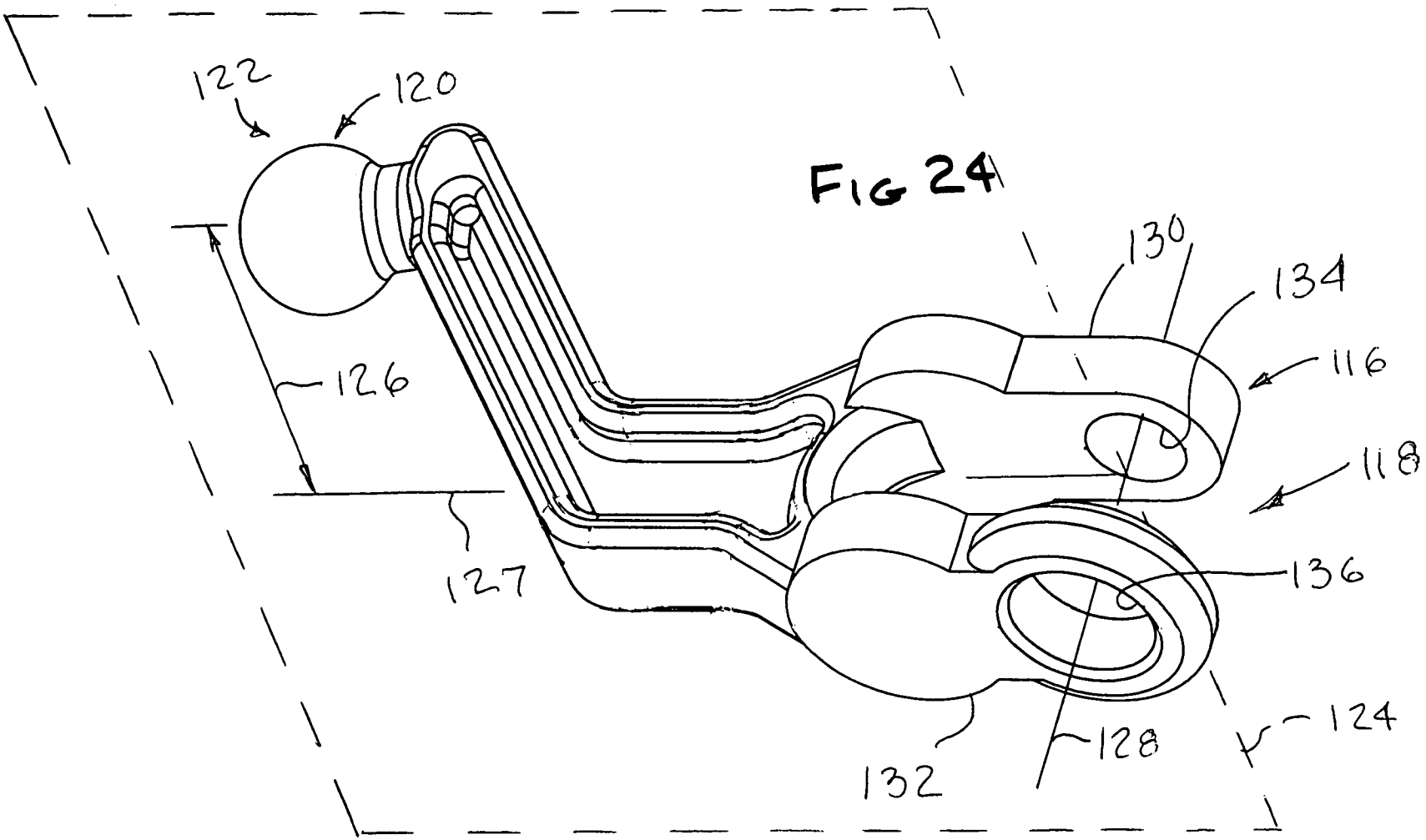
FIG. 24 is a perspective view of a lever useful in the practice of the present invention.
Figure 25:
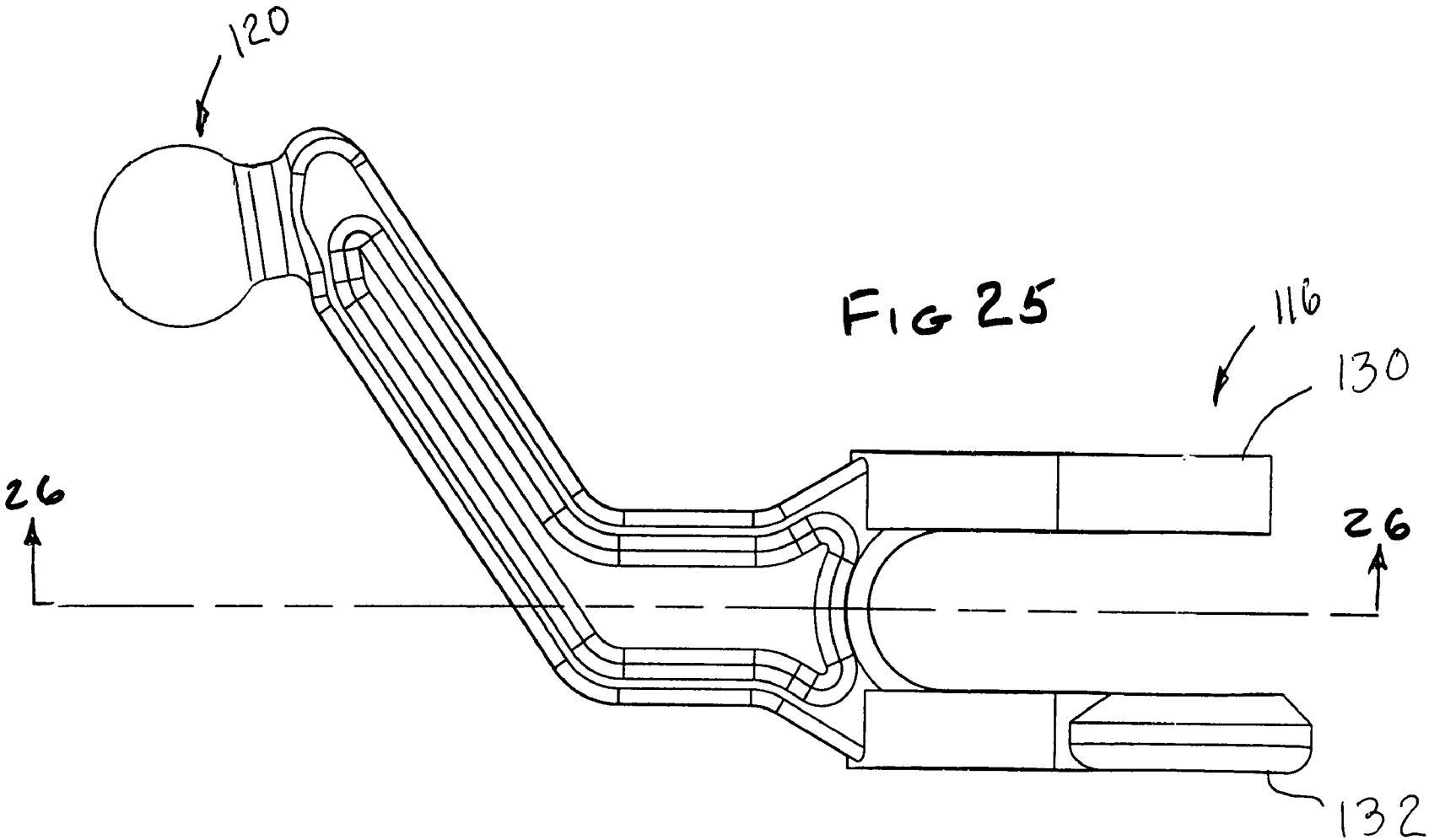
FIG. 25 is a top view of the lever of FIG. 24.
Figure 26:
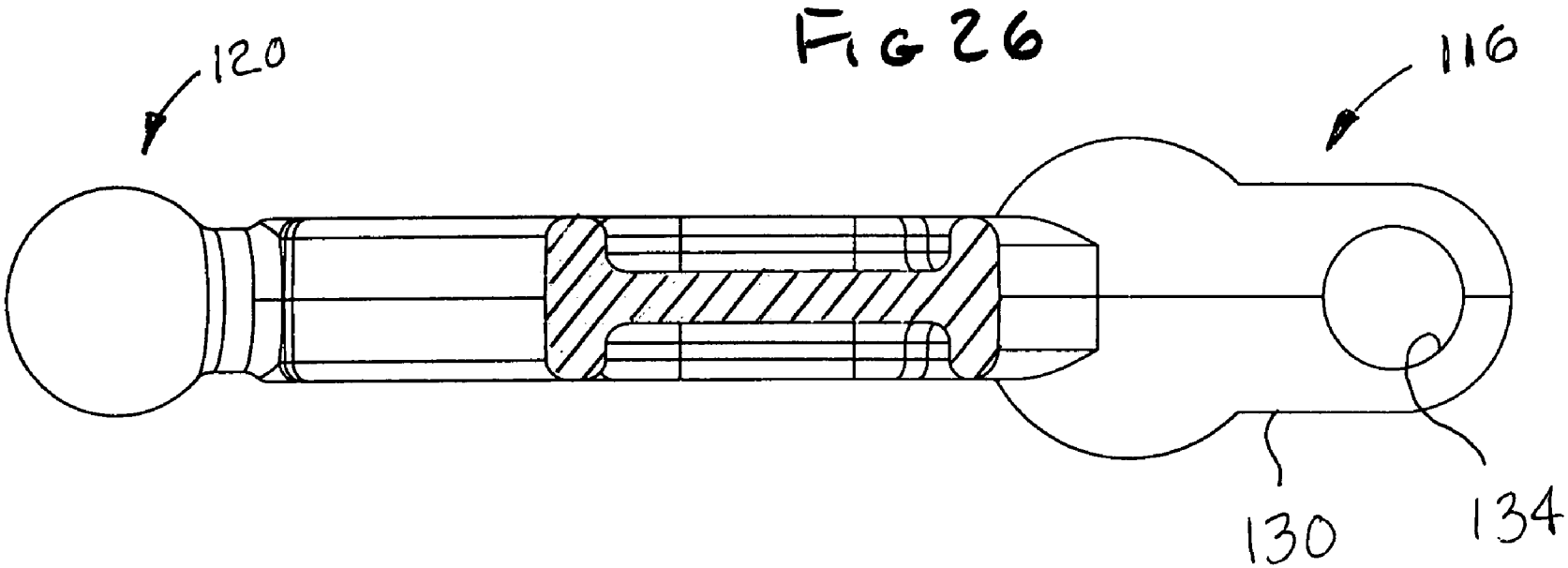
FIG. 26 is a section view taken along line 26—26 of FIG. 25.
Figure 27:
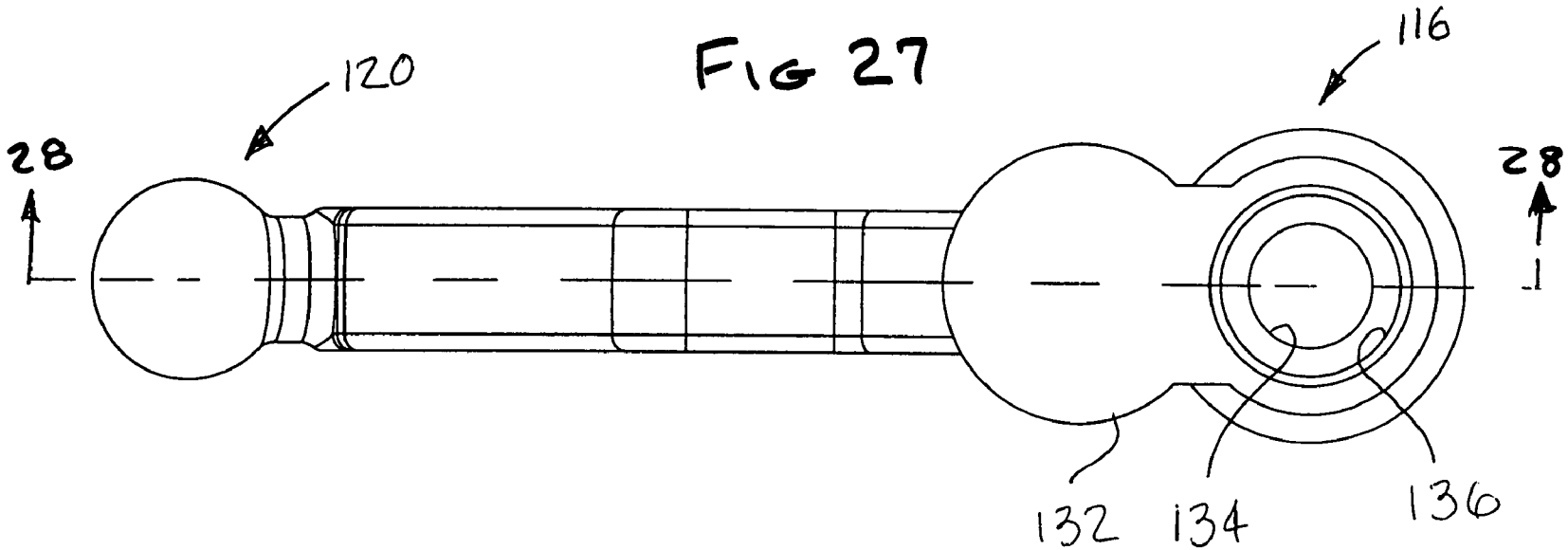
FIG. 27 is a side view of the lever of FIG. 24.
Figure 28:
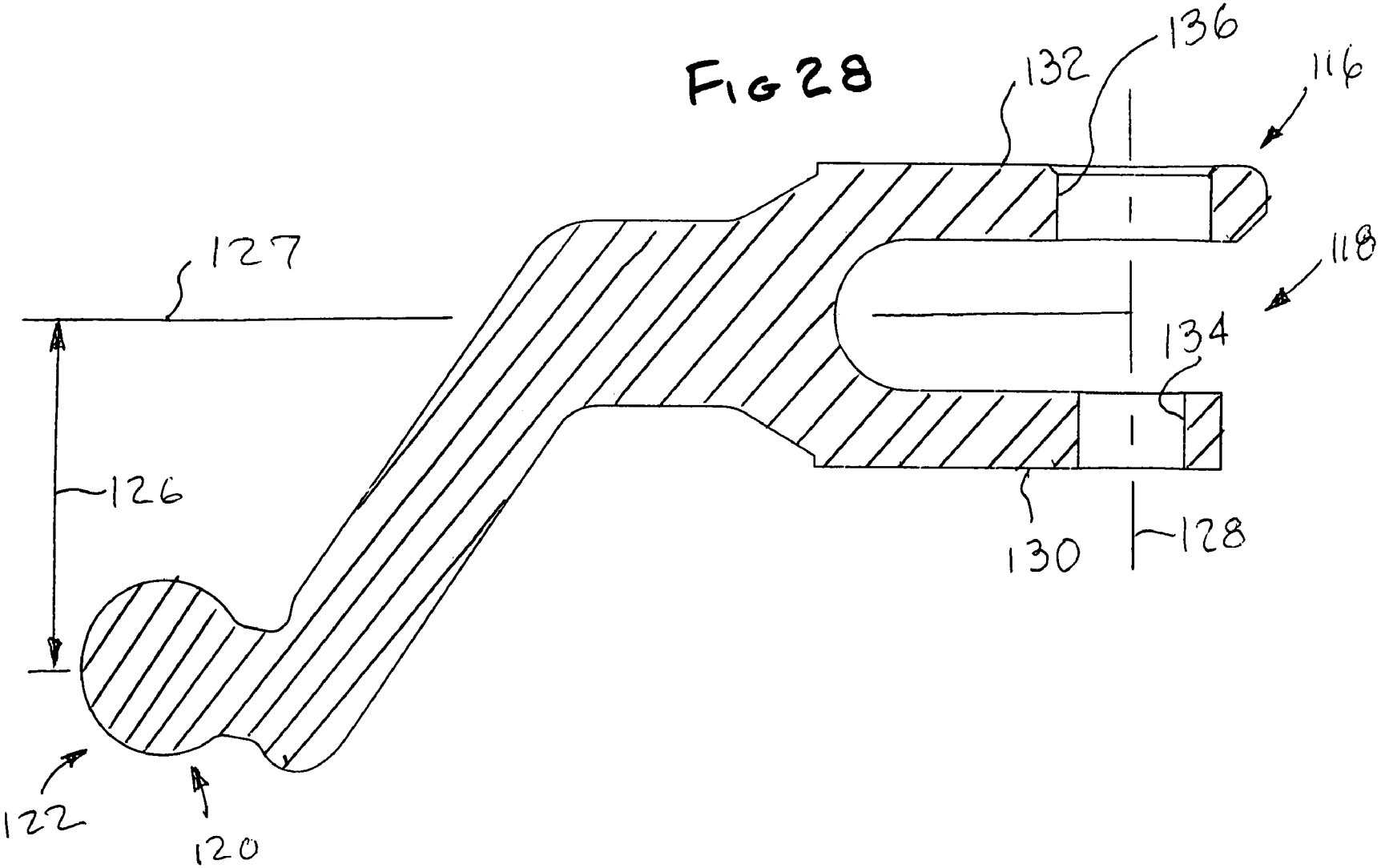
FIG. 28 is a section view taken along line 28—28 of FIG. 27.
Figure 29:
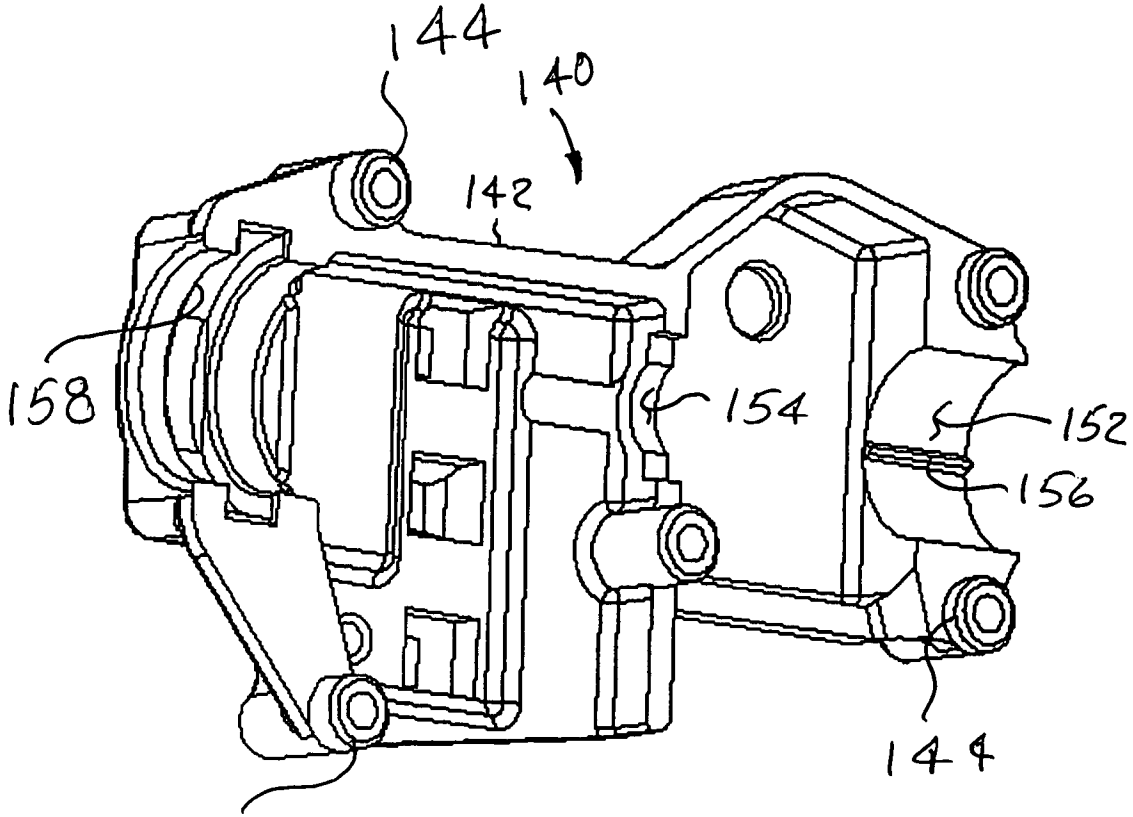
FIG. 29 is a perspective view of an inside of a cover for the base shown in FIG. 5.
Figure 36:
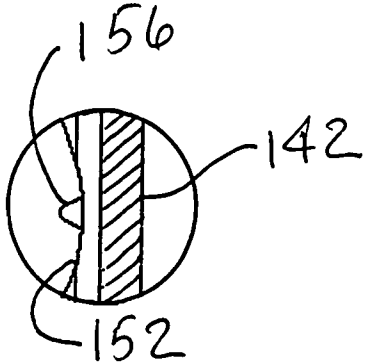
FIG. 36 is an enlarged view of detail 36 from FIG. 32.
Figure 30:
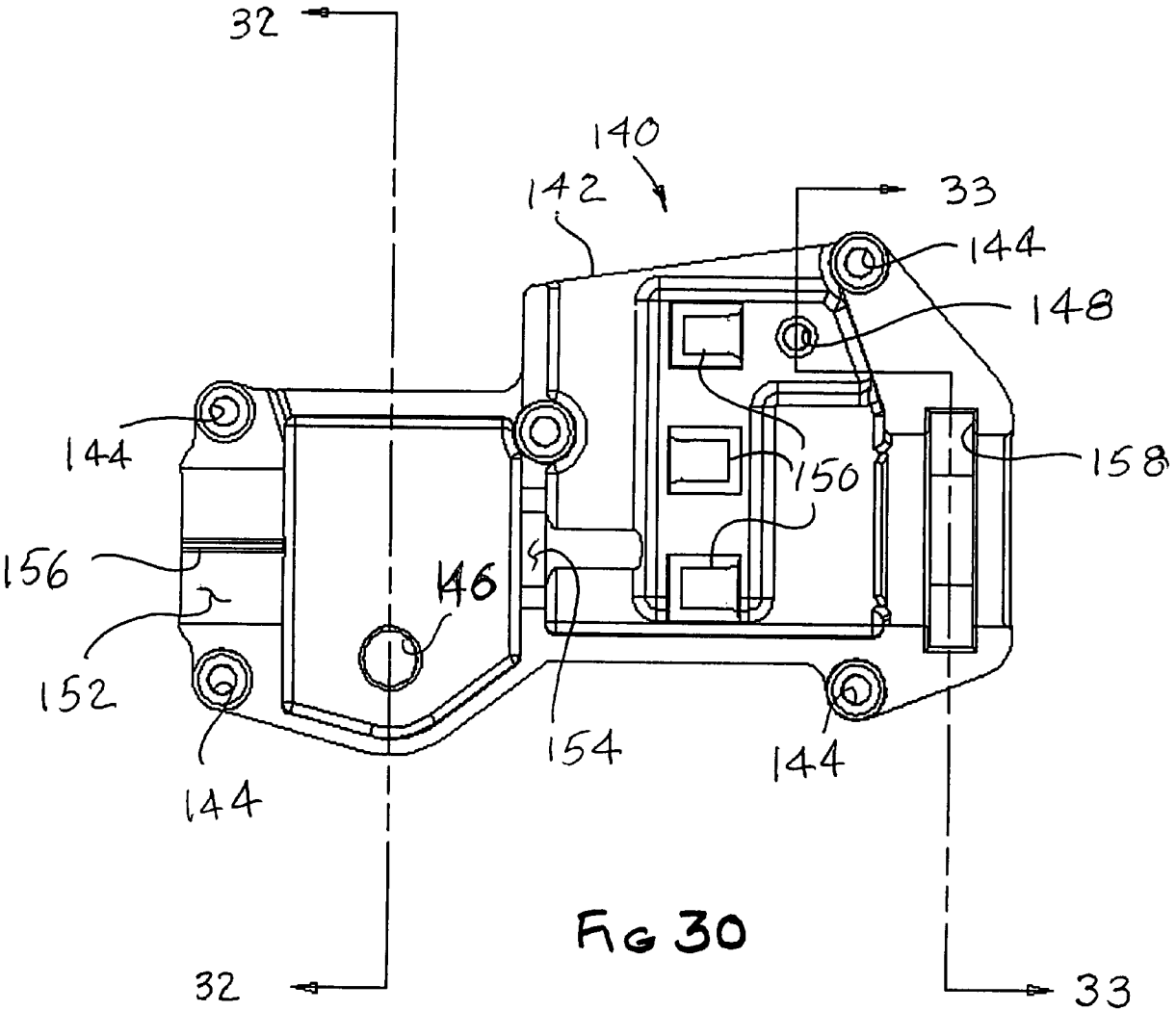
FIG. 30 is a side elevation view of the cover of FIG. 29.
Figure 32:
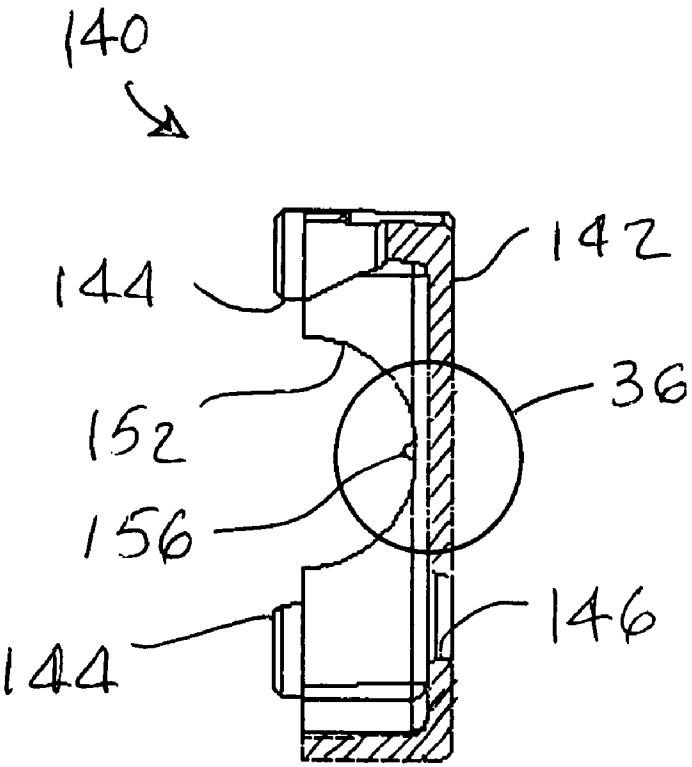
FIG. 32 is a section view of the cover taken along line 32—32 of FIG. 30.
Figure 31:
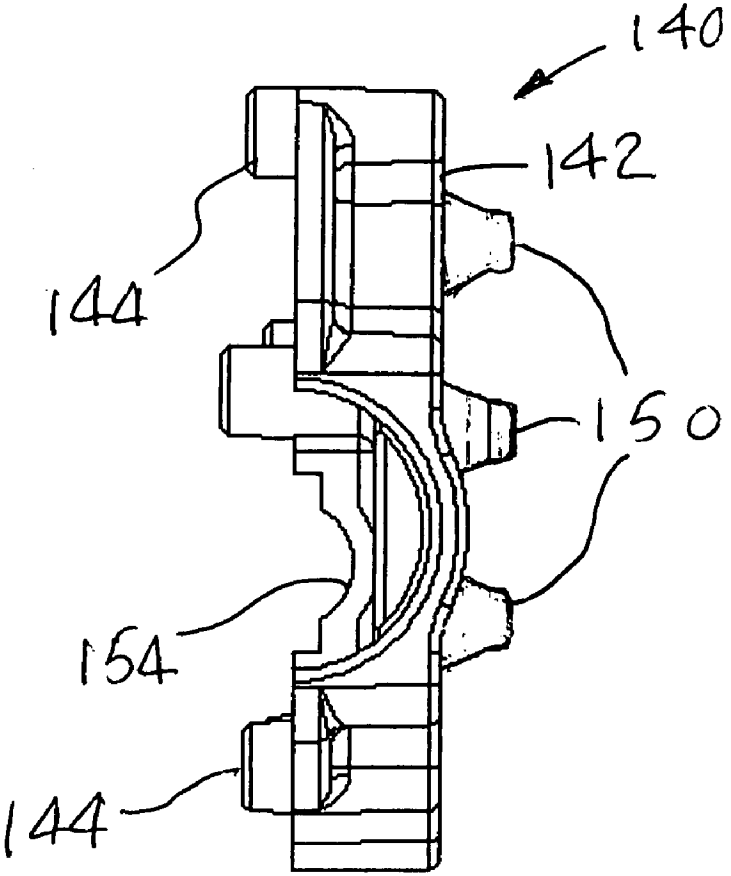
FIG. 31 is a first end view of the cover of FIG. 29.
Figure 33:
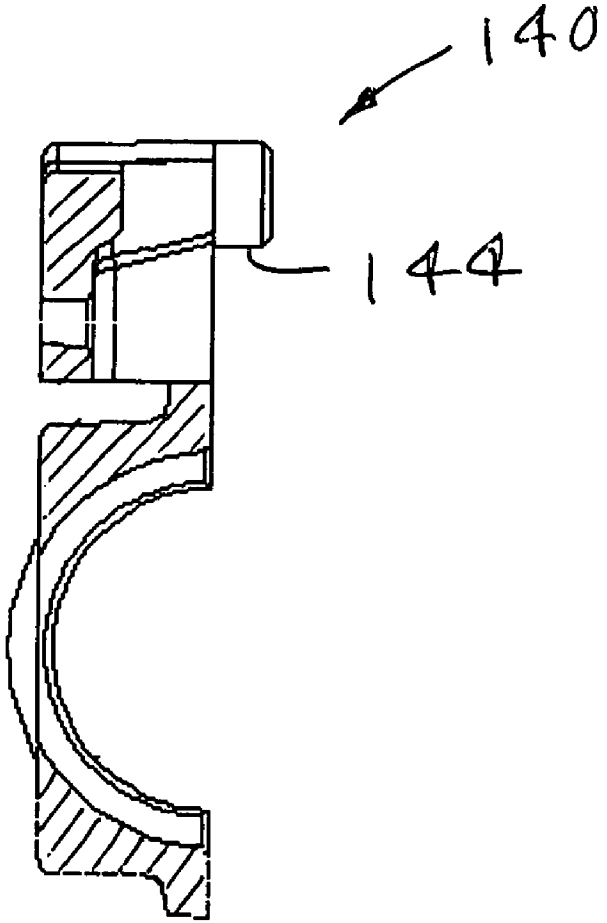
FIG. 33 is another section view of the cover taken along line 33—33 of FIG. 30.
Figure 34:
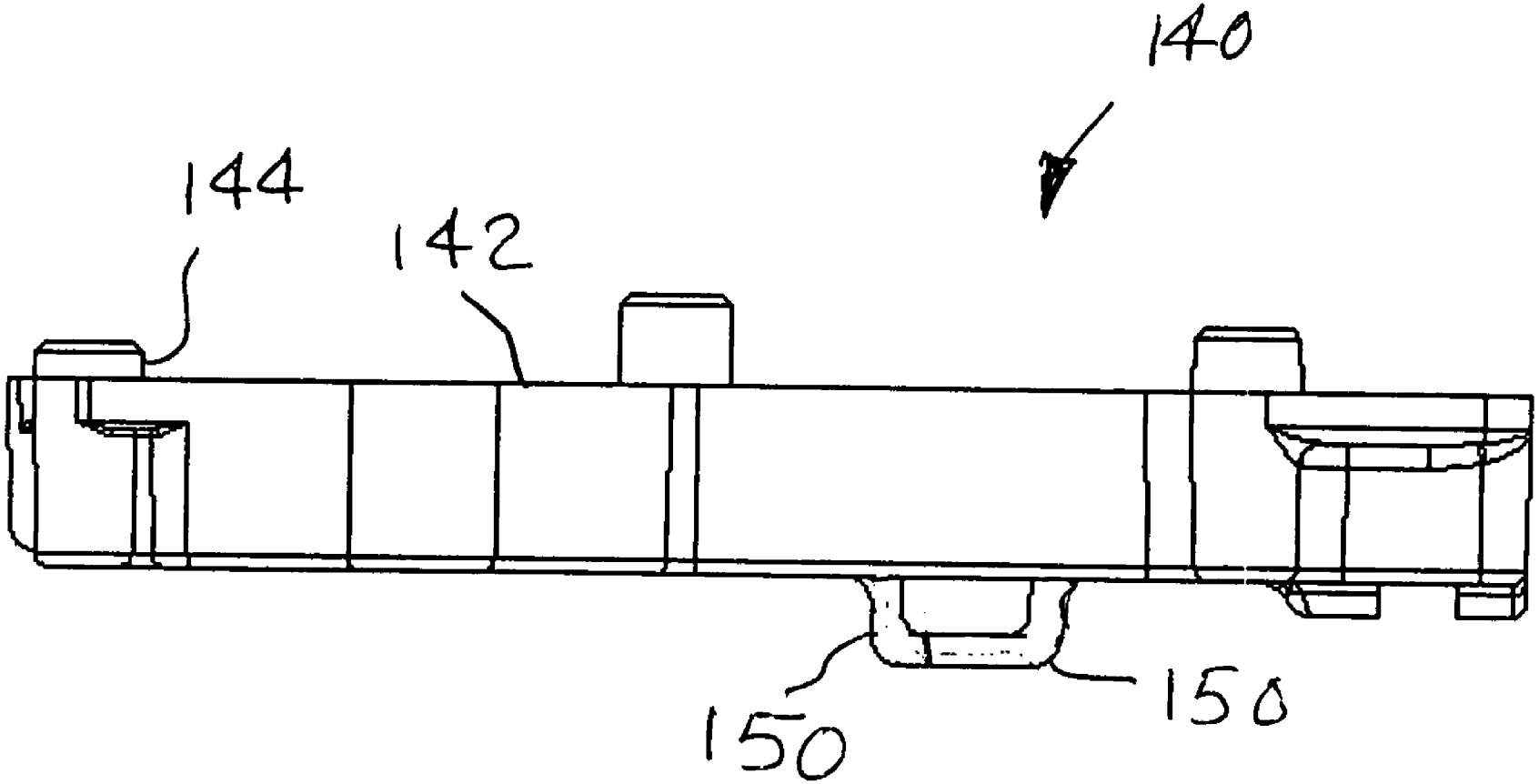
FIG. 34 is a bottom plan view of the cover of FIG. 29.
Figure 35:
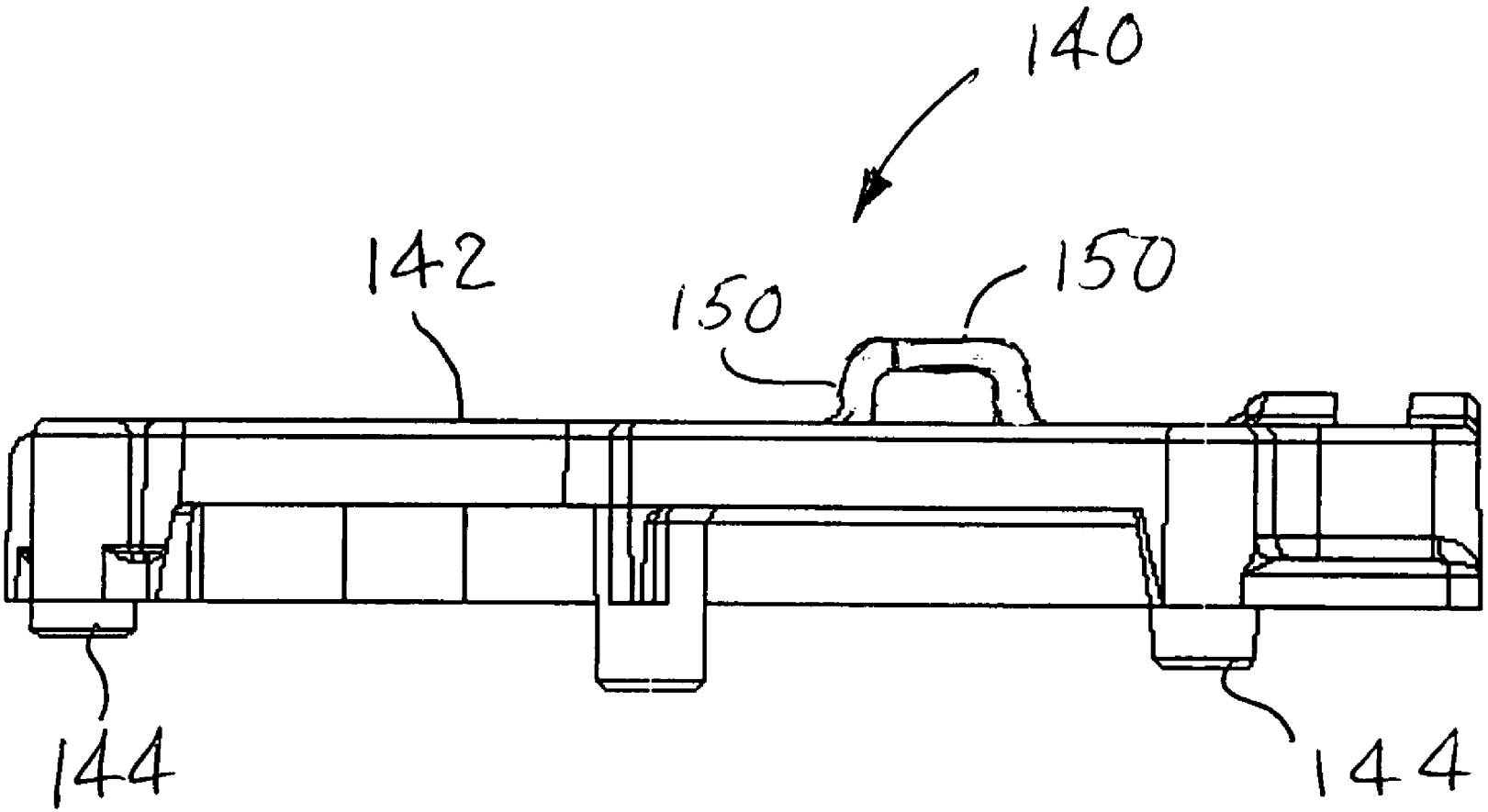
FIG. 35 is a top plan view of the cover of FIG. 29.
Figure 37:
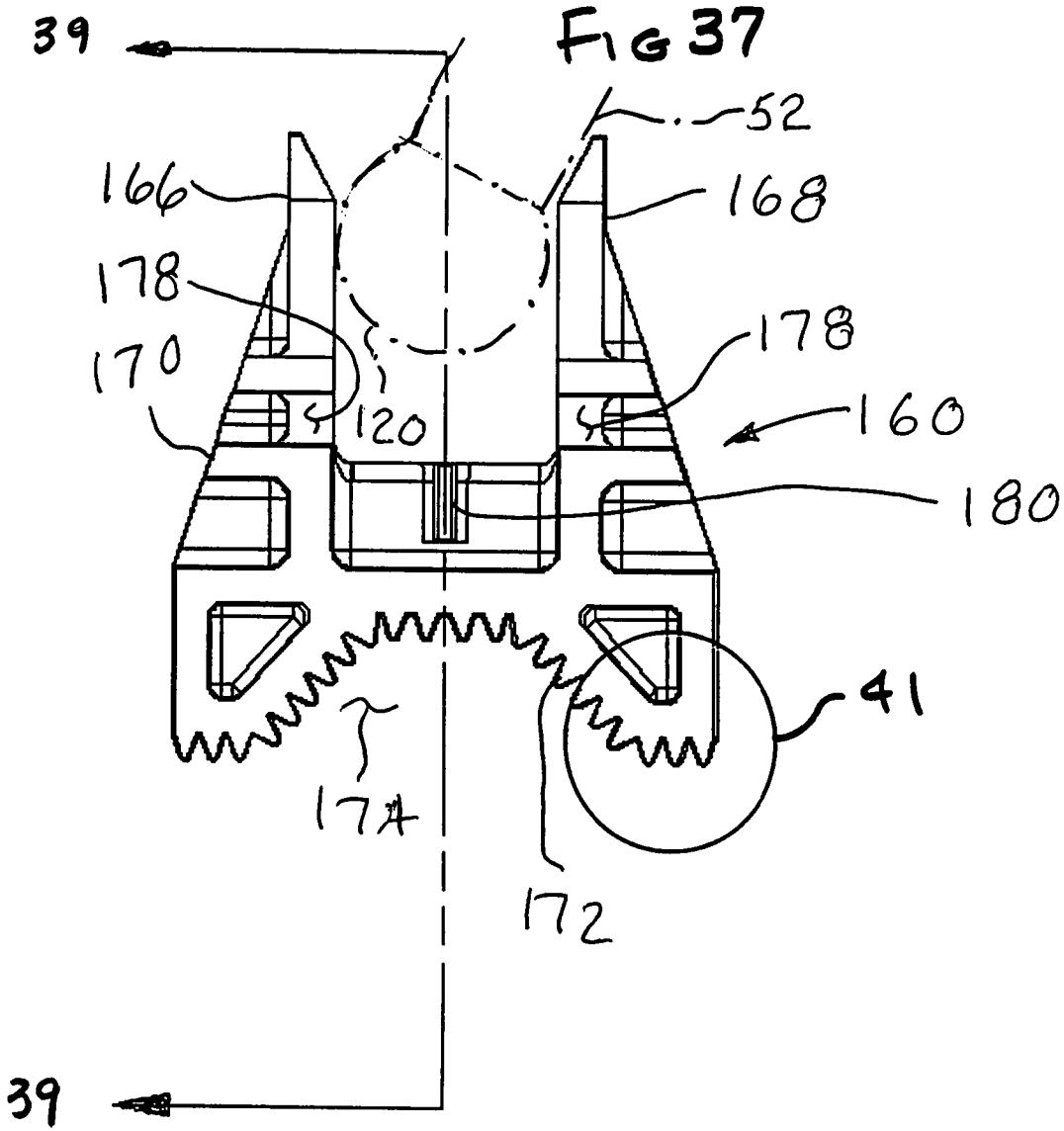
FIG. 37 is a top plan view of a sliding operator useful in the practice of the present invention.
Figure 38:
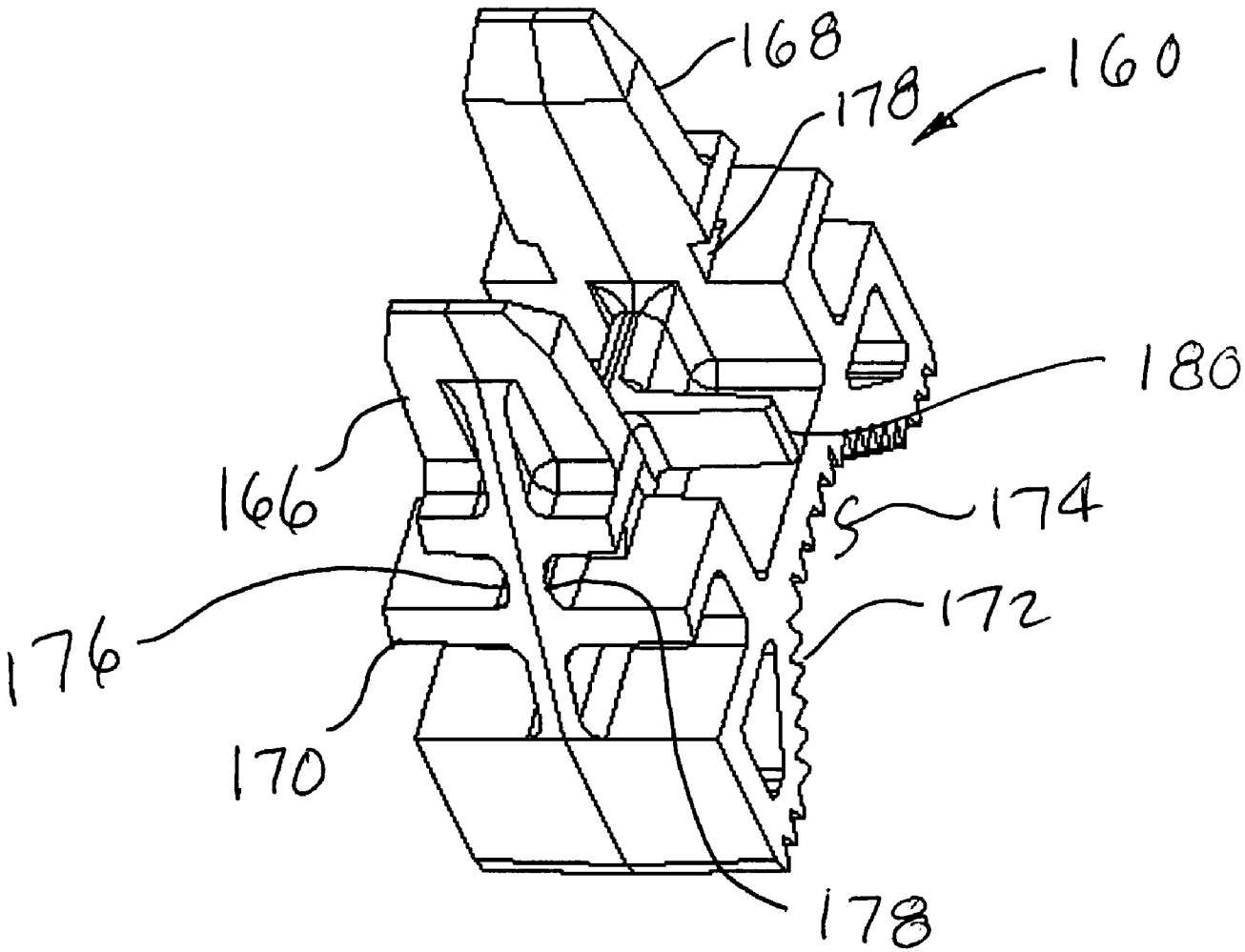
FIG. 38 is a perspective view of the sliding operator of FIG. 40.
Figure 39:
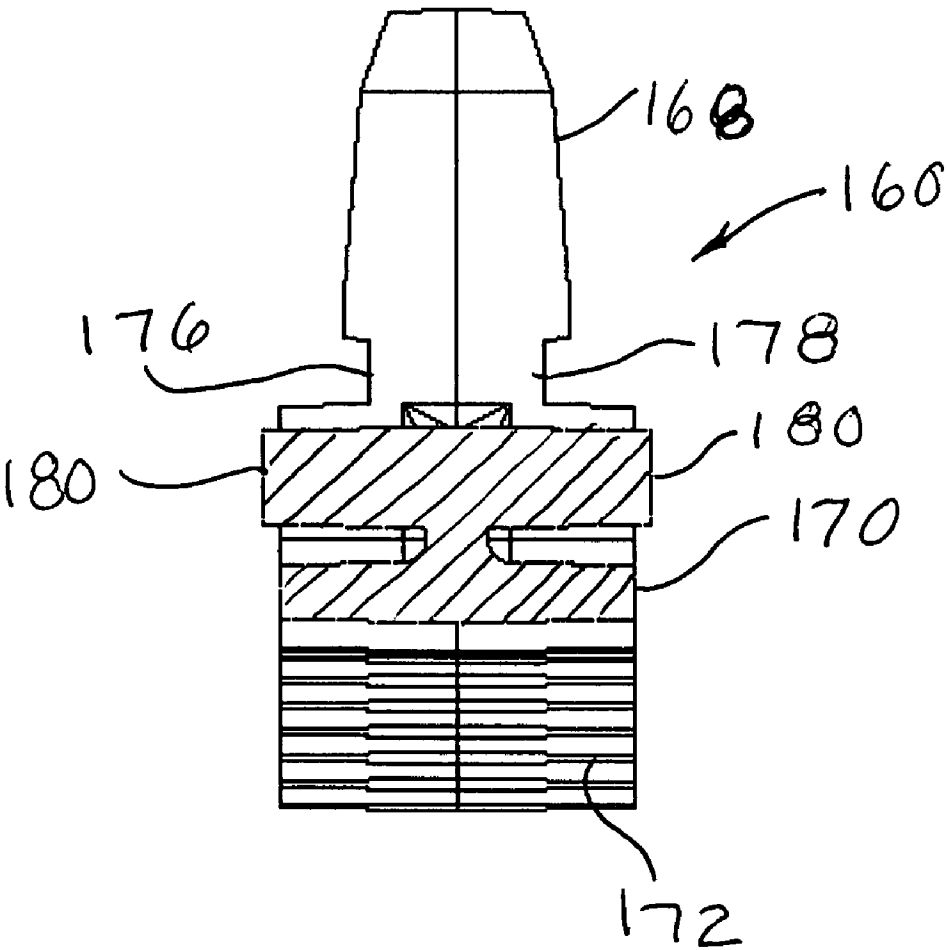
FIG. 39 is a section view taken along line 39—39 of FIG. 37.
Figure 40:
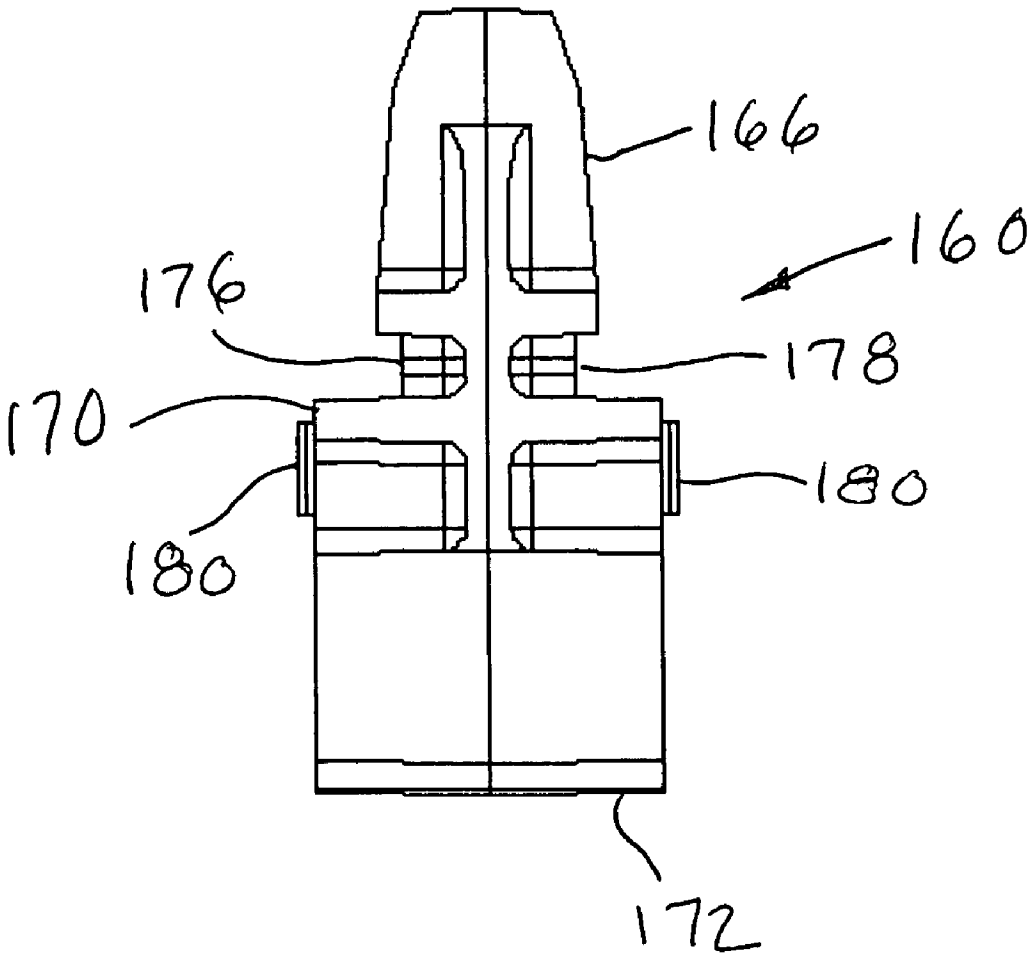
FIG. 40 is an end view of the sliding operator of FIG. 40.
Figure 41:
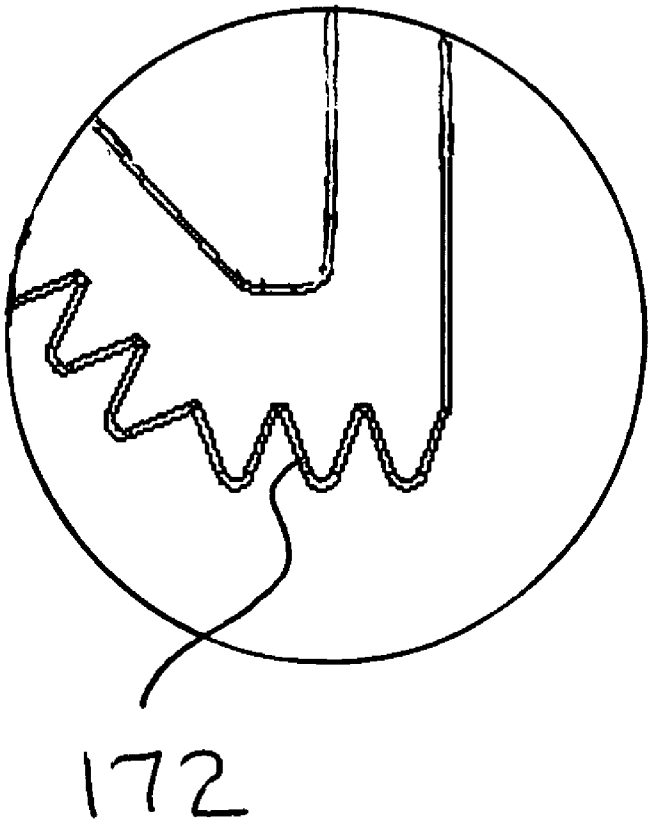
FIG. 41 is an enlarged view of detail 40 of the operator of FIG. 37.
Figure 42:
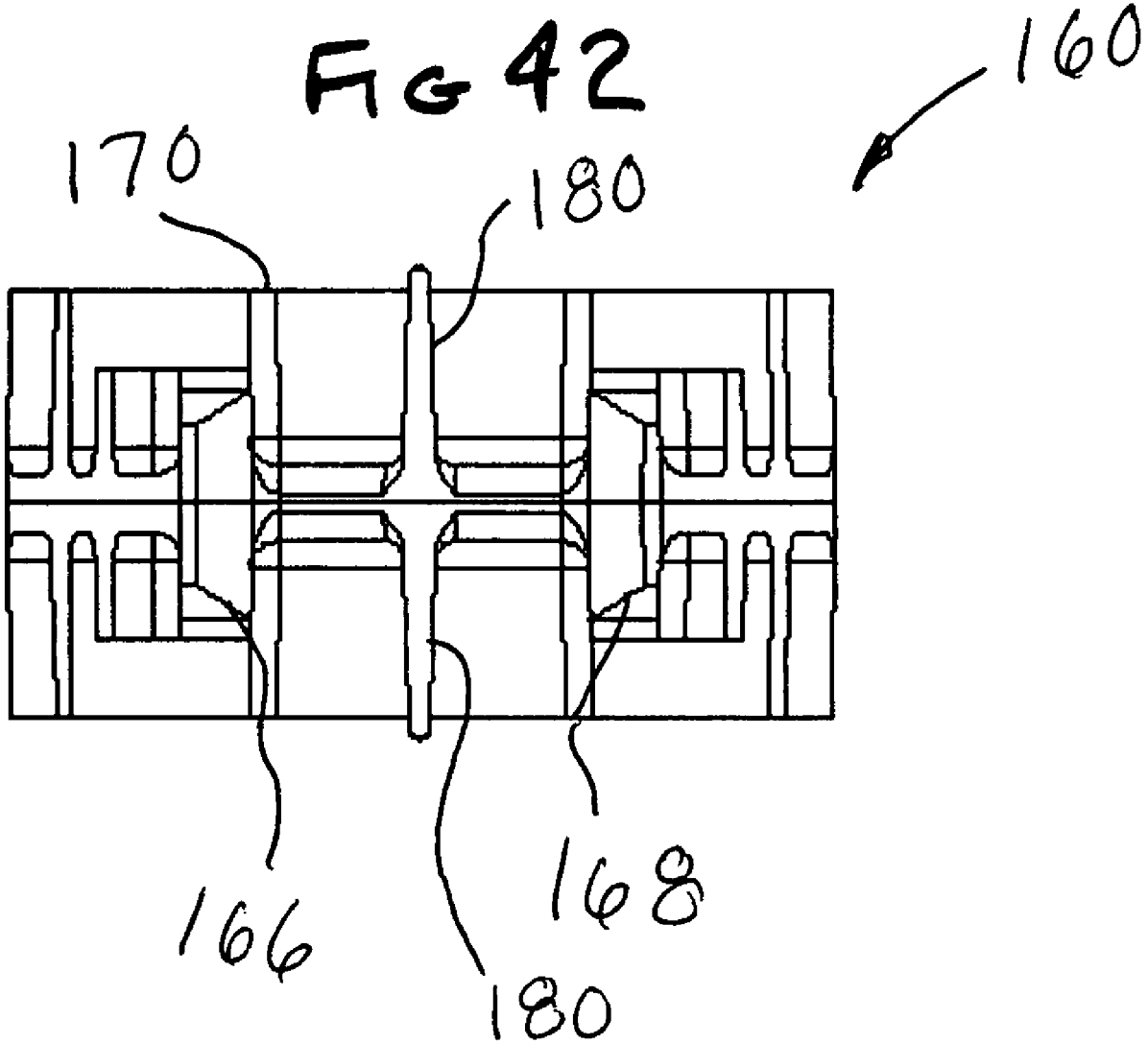
FIG. 42 is a back view of the sliding operator of FIG. 40.
Figure 43:
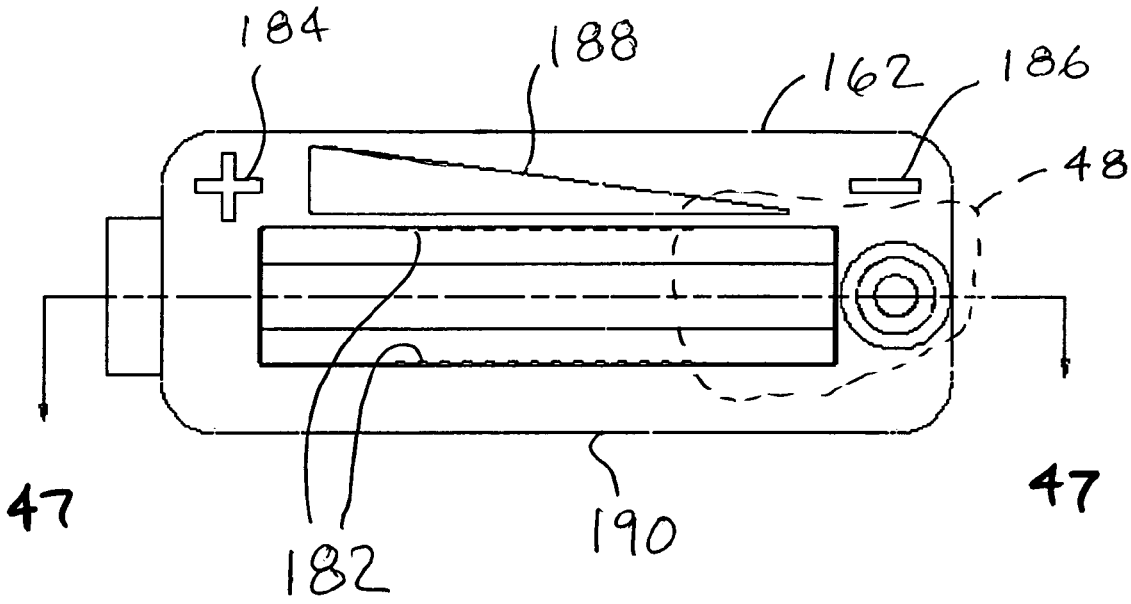
FIG. 43 is a front view of a bezel useful in the practice of the present invention.
Figure 44:
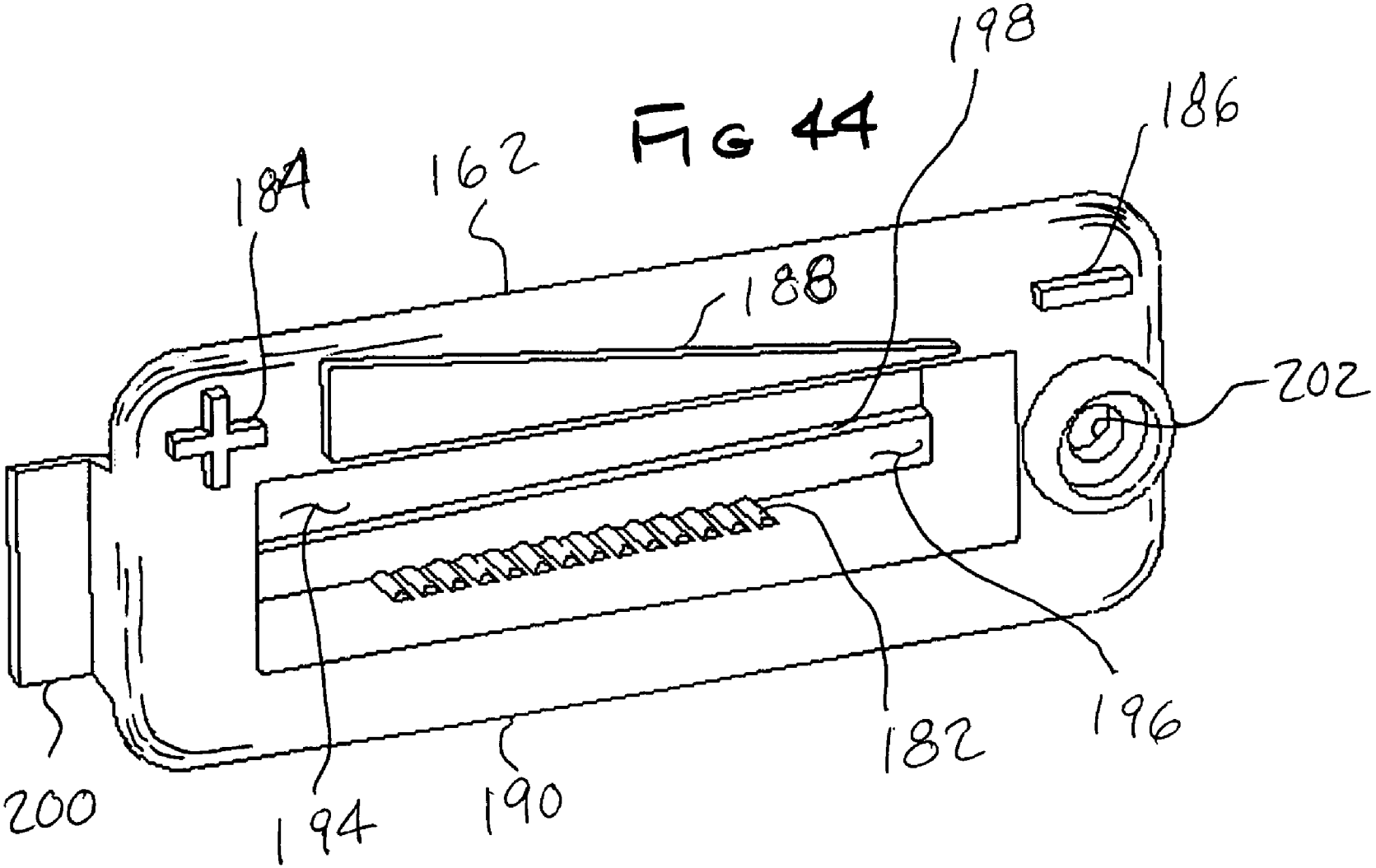
FIG. 44 is a front perspective view of the bezel of FIG. 43.
Figure 45:
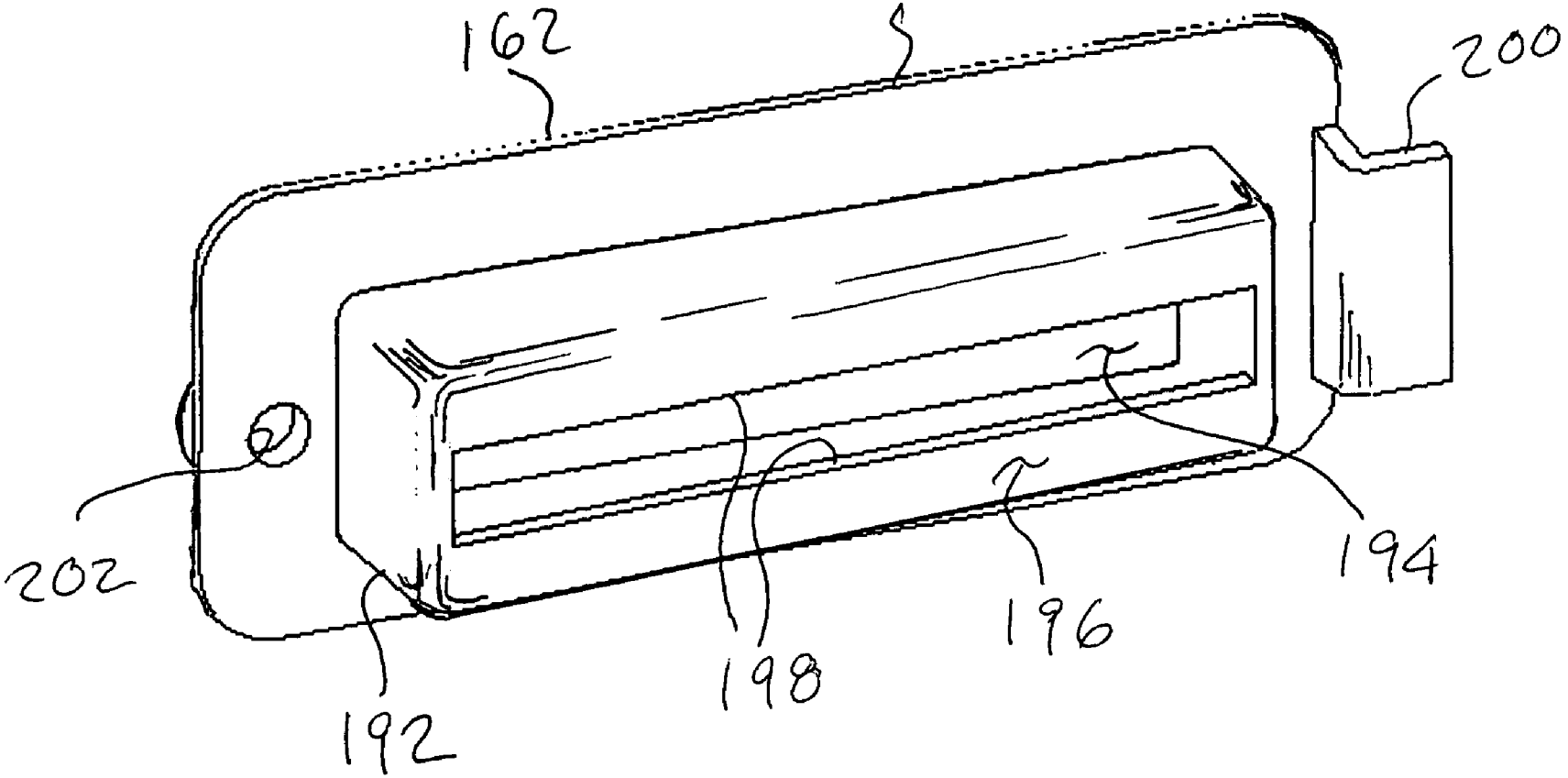
FIG. 45 is a rear perspective view of the bezel of FIG. 43.
Figure 46:
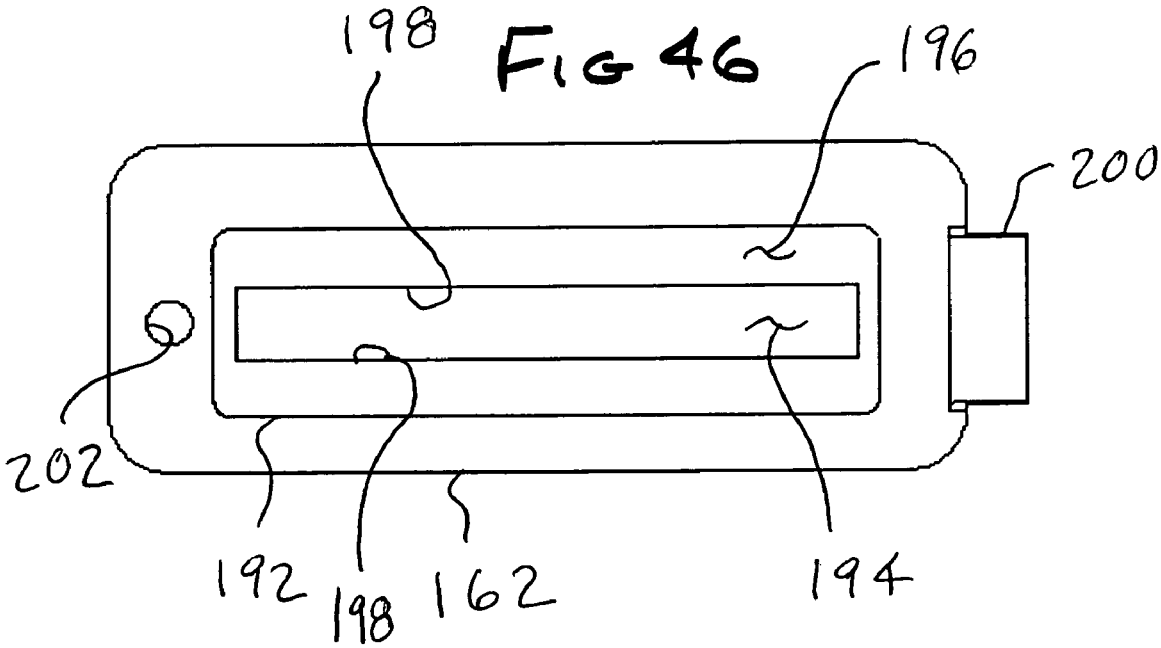
FIG. 46 is a rear elevation view of the bezel of FIG. 43.
Figure 47:
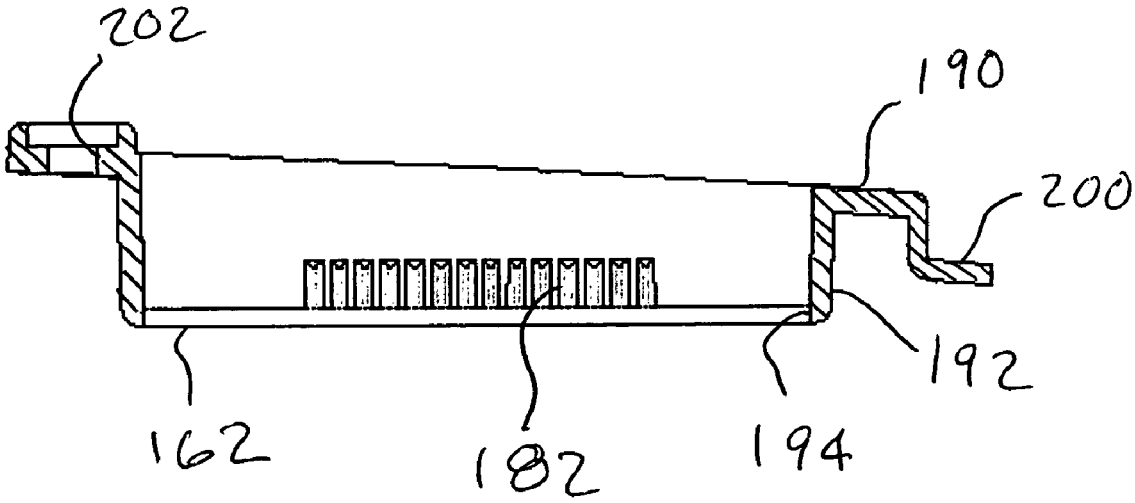
FIG. 47 is a section view taken along line 47—47 of FIG. 43.
Figure 48:
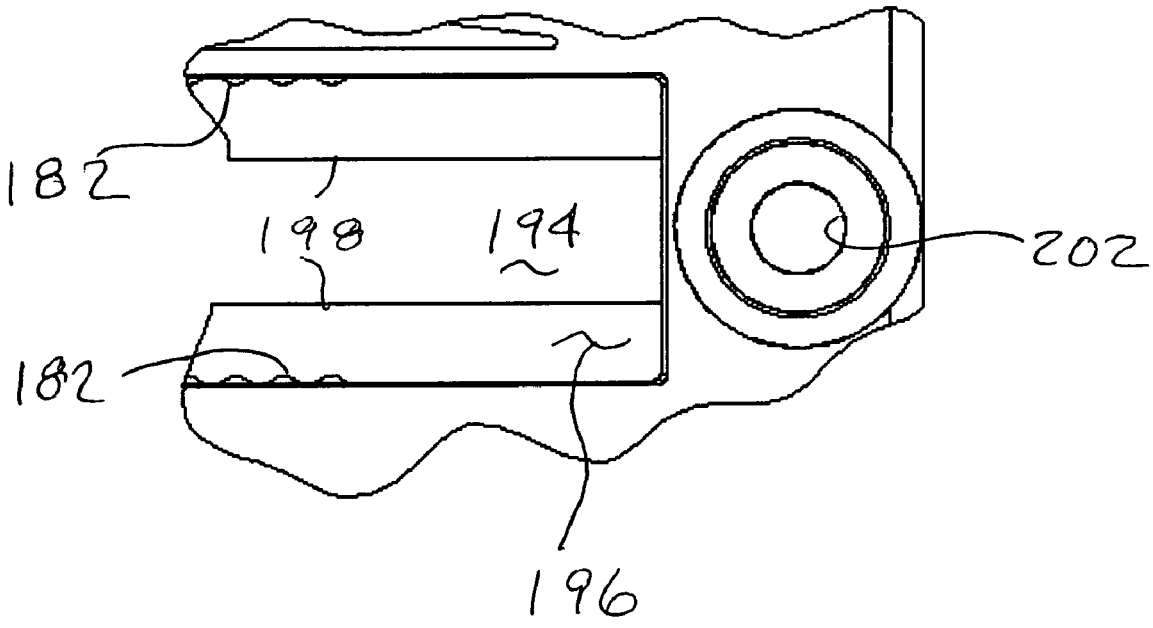
FIG. 48 is an enlarged view of detail 48 of the bezel of FIG. 43.

Referring now to FIGS. 3 and 4, the sliding control is coupled to a linear adjustment operator apparatus 34 for pressure control of the paint pump. Apparatus 34 has a base 36 with a first pivot point 38 and a second pivot point 40. Apparatus 34 also includes an electrical switch 42 mounted on the base 36 for rotational positioning about the first pivot point 38 within a range of angular positions corresponding to a range of pressures for the pump. It is to be understood that the switch 42 is responsive to a pressure sensor (not shown, but located with respect to the switch by a reference surface 44 for actuating the switch when the pressure sensor advances toward the switch with the amount of advance of the pressure sensor proportional to actual pump pressure. In the apparatus 34, a linear actuator 46 is movable along an axis 48 (coincident with section line 4—4) which is offset from the first pivot point 38, and therefore does not pass through it. The axis 48 is, however, in line with the switch 42 such that the linear actuator 46 will urge the switch 42 to rotate about the first pivot point 38 when the actuator 46 is in contact with the switch 42 and moving towards it. The switch 42 and spring 49 are retained on the switch support post 70 by a fastener which may be a push nut type fastener as manufactured by the Tinnerman Palnut Engineered Products company of 1060 West 130th Street Brunswick, Ohio 44212.

A resilient means in the form of a spring 49 provides for biasing the switch 42 in a first direction of rotation 50 about the first pivot point 38 and urges the switch 42 into contact with the linear actuator 46 to maintain contact between the switch 42 and the actuator 46 such that a change of position of the linear actuator 46 will result in a change in the position of the switch 42.

A manually positionable lever 52 is mounted for rotation about the second pivot point 40. The lever 52 is in contact with the linear actuator 46 for repositioning the linear actuator 46 along the axis 48 when the lever 52 is pivoted about the second pivot point 40. Moving the lever 52 moves the linear actuator 46 to reposition the switch 42 within a permitted range of angular positions for the switch 42. Setting the switch 42 to a specific position has the result of setting a desired pressure for the pump because the pressure sensor will activate the switch 42 at the desired pressure which corresponds to a manually selected desired position for the lever 52 via the sliding control 32.

Referring now most particularly to FIG. 4, the linear actuator 46 preferably includes a hollow main body or plunger 54, a dowel pin 56, a spring 58, a set screw 60 and an O-ring 62. Plunger 54 has threads 64 to mate with the set screw 60. Set screw 60 may be used to calibrate the maximum pressure for the assembly. Linear actuator 46 preferably has a non-circular cross section along at least a part thereof, and the base 36 preferably has a mating non-circular cross section in contact therewith to prevent rotation of the linear actuator 46 when the setscrew 60 is threaded into and out of the bore containing threads 64.

Referring now to FIGS. 5–11, various views of the base 36 may be seen. Base 36 has a main body portion 66 with a plurality of mounting holes 68 formed integrally therein. The first pivot point 38 is centered in a switch support post 70 extending from a recess 72 in the main body portion 66. The second pivot point is centered in a lever post 74. The main body portion has a first concave portion 76 and a second concave portion 78 for maintaining alignment of the linear actuator 46 with the axis 48. First concave portion 76 has a longitudinal tooth or projection 80 extending outward therefrom. Second concave portion 78 has a pair of rectangular reliefs 82 adjacent thereto, which may be seen most clearly in FIGS. 8–10.

Referring now to FIGS. 12–15, various views of the spring 49 may be seen. Spring 49 has a central coil 84 and a first end 86 and a second end 88 extending out from coil 84. Second end 88 preferably has an angled portion 90 formed therein. Referring now again to FIG. 3, the spring 49 is shown in a torsionally compressed state with the central coil received on switch support post 70, and with the first end 86 received in and acting against a wall of recess 72, and with the second end 88 acting against the switch 42 through angled portion 90. By urging the switch 42 in the direction of rotation 50, spring 49 eliminates any backlash or gap that might otherwise exist between switch 42 and the linear actuator 46, more particularly the dowel pin 56.

Referring now to FIGS. 16–23, various views and details of the main body portion 54 of the linear actuator 46 may be seen. Main body portion 54 has a generally cylindrical shape, with a first enlarged diameter portion 92 at a proximal end 94, and a second enlarged diameter portion 96 at a distal end 98. Portion 92 has a groove 100 for receiving O-ring 62. Portion 96 has a pair of key portions 102 extending between a distal end enlarged diameter ring 104 and an intermediate enlarged diameter ring 106. The portion 96 provides the non-circular cross-section that mates with the rectangular relief 82 adjacent the second concave portion 78 in the base 36, thereby providing mating non-circular cross sectional features preventing rotation of the linear actuator 46 when the set screw 60 is adjusted. A through bore 108 extends completely through portion 54 with a first, smaller diameter portion 110 connected to a second, larger diameter portion 112. Portion 112 contains threads 64. First enlarged diameter portion 92 may have a plurality of reliefs 114 therein to reduce wall thickness in aid of molding part 54 (preferably of acetal polymer material).

Referring now again to FIGS. 3 and 4, the linear actuator 46 includes the main body portion 54 carrying O-ring 62, dowel pin 56, spring 58, and set screw 60. When the linear actuator is set to a desired position within base 36, the switch 42 is positioned with respect to the base to correspond to a desired pressure setting wherein the pressure transducer (not shown, but to be understood to be received in the base and positively positioned by reference surface 44) will actuate and deactuate the switch 42 to control pump pressure to the desired pressure. O-ring 62 will drag against longitudinal projection 80 to maintain whatever setting of the linear actuator 46 is achieved by positioning lever 52.

Referring now to FIGS. 24–28, various views of the lever 52 may be seen. Lever 52 has a fork 116 at a distal end 118 and a ball 120 at a proximal end 122. As may be seen most clearly in FIGS. 26 and 27, the ball 120 and fork 116 are aligned in a common plane 124, while ball 120 is offset by a distance 126 from a perpendicular 127 to an axis of rotation 128 of fork 116 within plane 124, as may be seen most clearly in FIGS. 24, 25 and 28. Fork 116 is preferably formed of a pair of arms 130, 132, with arm 130 having an aperture 134 and arm 132 having an aperture 136. Apertures 134 and 136 are sized to be received over lever post 74 in base 36 for rotation about the first pivot point 38.

Referring now to FIGS. 29–36, various aspects of a cover 140 for base 36 may be seen. Cover 140 mates with base 36 and encloses actuator 46 and, together with base 36, provides an access opening for the lever 52 to protrude from an enclosure formed when the cover 140 is received on the base 36. Cover 140 has a main body portion 142 corresponding to the main body portion 66 of the base 36. Cover 140 has a plurality of screw towers 144 for alignment with mounting holes 68 in base 36, and which are each adapted to receive a self-tapping screw (not shown) to retain cover 140 and base 36 together. Cover 140 has a lever post aperture 146 sized and positioned to receive the lever post 74 of the base 36. Cover 140 also has a switch support post aperture 148 positioned and sized to receive the switch support post 70 of the base 36. Cover also may have three interdigitated fingers 150 to receive and retain wires (not shown) attached to switch 42. Cover 140 has first and second concave portions 152, 154 corresponding to concave portions 76 and 78 in the base 36. Similarly, cover 140 has a rib or tooth 156 in portion 152 and a reference surface 158 located at an opposite end of the cover 140 positioned to align with reference surface 44 in the base 36 when the cover 140 and base 36 are assembled together.

Figure 2:
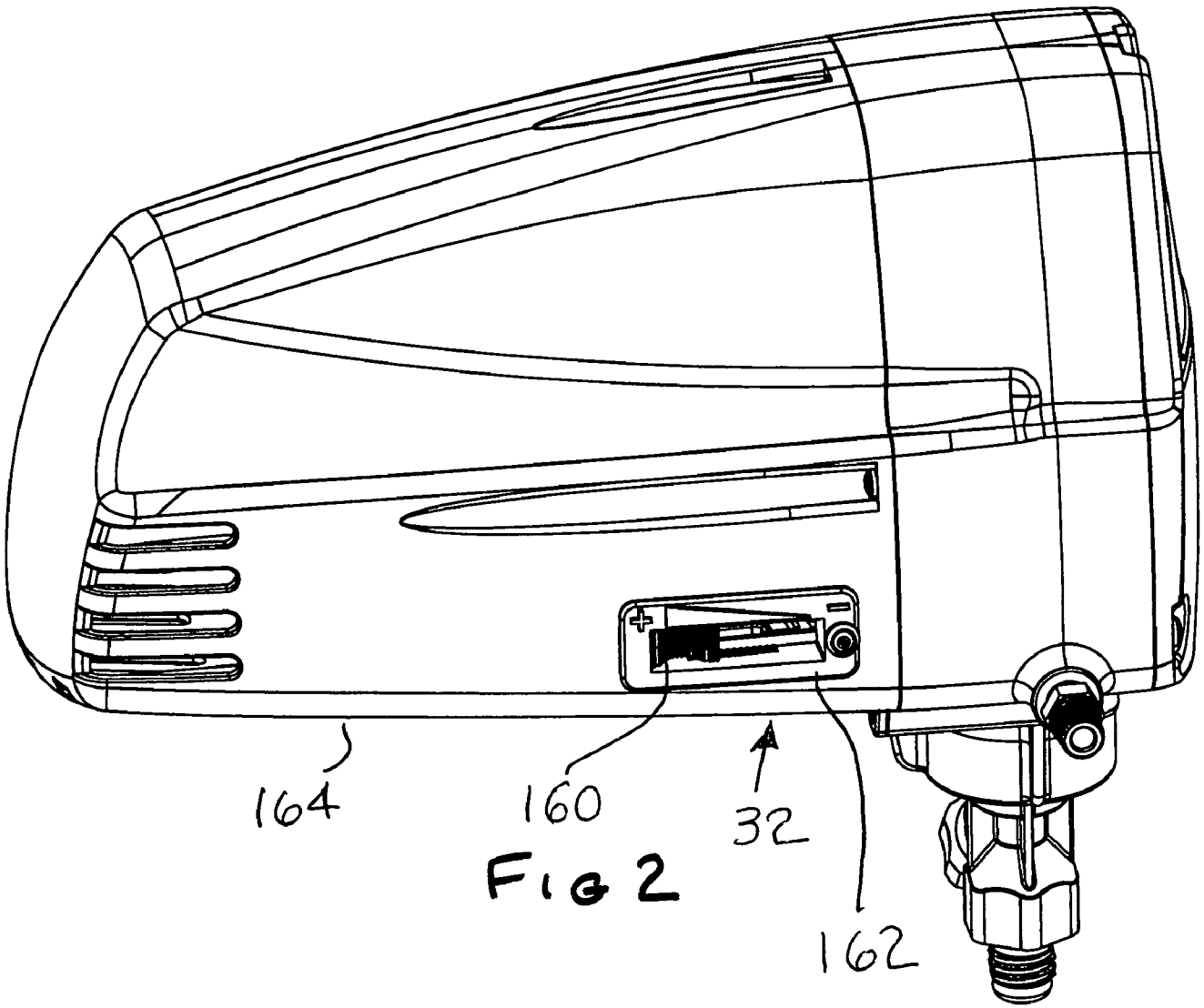
FIG. 2 is a closeup view of the side of a paint pump similar to that shown of FIG. 1 showing a user accessible adjustment device for the present invention.

Referring now again to FIG. 2 and also to FIGS. 37–47, various views of a slide operator 160 and bezel 162 may be seen. In FIG. 2, the slide operator 160 and bezel 162 are shown assembled together as the sliding control 32. It is to be understood that the sliding control 32 has the slide operator 160 assembled into the bezel 162, and the combination attached to a portion of an outer pump housing 164, with the ball 120 of the lever 52 received in between a pair of fingers 166, 168 of the slide operator 160, as indicated in phantom in FIG. 37.

Slide operator 160 has a main body portion 170 interconnecting fingers 166, 168 at the rear of operator 160 with a ribbed front surface 172 available to a user to move the slide operator in the bezel 162. Ribbed front surface 172 may have a recess 174 to receive a fingertip of the user for convenience in setting the slide operator to a desired position, corresponding to to a desired pressure to be delivered by the pump 30. Operator 160 also preferably has a pair of grooves 176, 178 to retain the operator to the bezel, once the operator is installed therein. Operator 160 also may have one or two flexible projections 180 extending from the main body portion 170 generally perpendicularly to fingers 166, 168. In practice only one projection is needed, however it has been found desirable to mold operator 160 with a pair of projections 180. The projections 180 are each designed to interact with a respective row of projections or bumps 182 in bezel 162 to both allow sliding movement of the operator 160 with respect to the bezel 162 and to retain the operator 160 at a location where it is positioned in the bezel 162 by a user.

Referring now also to FIGS. 43–48, various views of the bezel 162 may be seen. Bezel 162 provides a mounting frame and support for slide operator 160, permitting a user to move the slide operator within an operating range to select a desired operating pressure. The operating range is indicated by visual indicia on the bezel. A "+" sign 184 is located at one end of the operating range to indicate MAXIMUM pressure, and a "–" sign 186 is located at the other end of the operating range to indicate MINIMUM pressure. A ramp like indicia 188 is located between signs or indicia 184 and 186 to indicate increasing pressure as the slide operator 160 is moved from the MINIMUM to the MAXIMUM end of the operating range. Indicia 184–188 are located on a front flange 190 of bezel 162. An open front box-like shape 192 is preferably integrally formed to the front flange 190 of bezel 162. Box 192 has a rectangular aperture 194 in a rear wall 196 thereof to permit the fingers 166, 168 of the slide operator 162 to project therethrough when operator 160 is installed in box 192 of bezel 162. The aperture 194 forms a pair of rails 198 in rear wall 196. When the sliding operator 160 is installed, the grooves 176, 178 are received over rails 198, retaining operator 160 to bezel 162, while still allowing sliding movement therebetween within the operating range permitted by aperture 194. The projections 180 will plastically deform as the operator is moved with respect to the bezel as the projections move past individual bumps 182 formed in the box 192. When the projections 180 are located between individual bumps, they will relax, either partially or fully, retaining the operator in the position set by a user within the operating range.

Bezel 162 preferably has an offset flange 200 at one end thereof and a mounting hole 202 at the other end to facilitate mounting of the bezel and sliding operator as a subassembly secured to a portion 164 of the pump housing, as shown in FIG. 2, it being understood that a screw is received in mounting hole 202 for attachment of the subassembly to the pump housing 164.

Slide operator 160 may be made of acetal polymer, and the bezel 162 may be formed of nylon. Bumps 182 may be of a domed shape with a radius of 0.020 inches and individual width of 0.052 inches and may be spaced apart from each other on 0.080 inch centers, forming recesses between individual bumps. It is also to be understood that the projections 180 may be formed on the bezel with one or more bumps and recesses formed on the slide operator, if desired.

It may thus be seen that the slide operator and bezel have interengaging surfaces (the projections 180 and the bumps 182) to retain the slide operator at a position within the operating range. It is to be understood that, alternatively, one or more projections may be formed on the bezel, with the bumps formed on the slide operator, if desired, with appropriate changes to the parts to provide mechanical clearance for such an alternative.

The bumps 182 are to be understood to be in the form of a corrugated surface in contact with the resilient projection. The corrugated surface forms a linear array of alternating hills and valleys, with the resilient projection movable between the valleys as the slide operator is moved with respect to the bezel.

Figure 49:
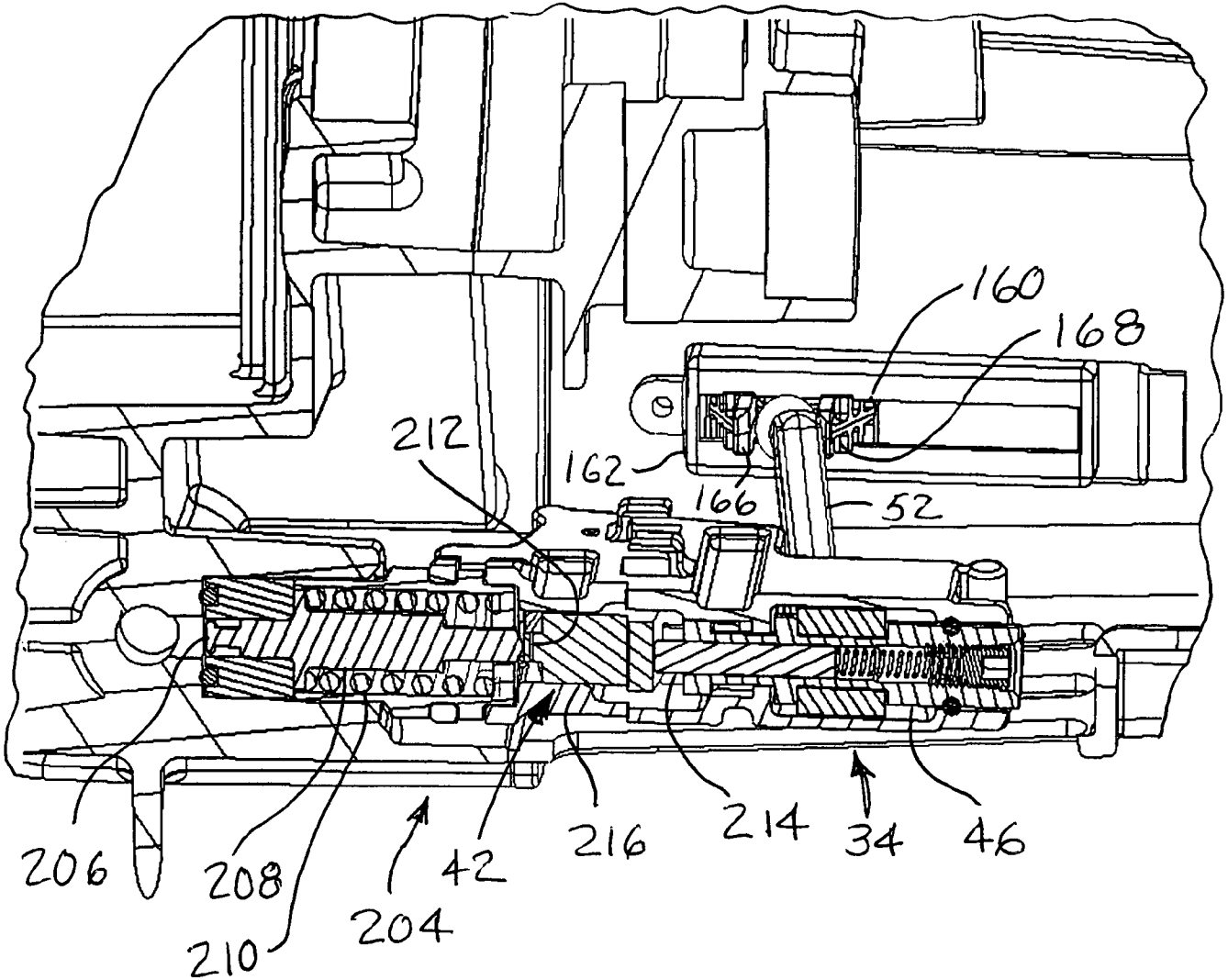
FIG. 49 is an enlarged fragmentary view of the pressure control system of the present invention installed in a pump with the apparatus of FIGS. 3 and 4 and a pressure transducer shown in section.

Referring now to FIG. 49, a fragmentary view of the pressure control system of the present invention may be seen. In this view, a pressure transducer 204 is shown in section, along with the operator apparatus 34, to illustrate further details of the invention. The lever 52 is shown engaged with fingers 166 and 168 of the slide operator 160 in bezel 162. Fluid pressure at a distal end 206 of the pressure transducer 204 will move core 208 to the right, compressing spring 210 and eventually acting on an operator 212 of switch 42, to electrically open the switch when the desired pressure is reached. The linear actuator 46 acts through a stem 214 to urge a housing 216 of the switch 42 to the left in FIG. 49, with the position of the housing 216 set by the position of slide operator 160, positioned to a desired location corresponding to a desired operating pressure level. The positions of parts shown in FIG. 49 corresponds to a minimum pressure setting.

Calibration of the maximum pressure setting may be achieved by connecting a pressure gauge to an outlet of the pump and operating the pump with the slide operator moved as far as possible to the "+" end of the operating range (moving the lever 52 to an end of travel position) and then adjusting the set screw 60 (see FIG. 4) until the desired maximum pressure is obtained. A typical adjustment would be to set the OFF pressure to 2900 psi, e.g., the pressure at which the pump turns switch 42 OFF in response to operation of the pressure sensor engaged with the reference surface 44.

This invention is not to be taken as limited to all of the details thereof as modifications and variations thereof may be made without departing from the spirit or scope of the invention.

The invention claimed is:

1. Apparatus for adjusting pressure in a paint pump comprising:

a. a base having a first pivot point and a second pivot point;

b. an electrical switch mounted on the base for rotational positioning about the first pivot point within a range of angular positions corresponding to a range of pressures for the pump, the switch being responsive to a pressure sensor for actuating the switch when the pressure sensor advances toward the switch wherein the amount of advance of the pressure sensor is proportional to pump pressure;

c. a linear actuator movable along an axis offset from the first pivot point and in line with the switch;

d. resilient means for biasing the switch in a first direction of rotation about the first pivot point and into contact with the linear actuator such that a change of position of the linear actuator results in a change in position of the switch; and e. a manually positionable lever mounted for rotation about the second pivot point, the lever in contact with the linear actuator for repositioning the linear actuator along the axis when the lever is pivoted about the second pivot point such that the switch is repositionable within the range of angular positions to set a desired pressure for the pump by manually selecting a desired position for the lever.

2. The apparatus of claim 1 further comprising friction means for providing resistance to repositioning of at least one of the linear actuator and lever.

3. The apparatus of claim 2 wherein the friction means comprises an O-ring mounted on the linear actuator and in contact with the base.

4. The apparatus of claim 2 wherein the base further comprises a rib extending parallel to the axis and in contact with the O-ring.

5. The apparatus of claim 1 further comprising a slide operator engaged with the lever and movable within an operating range for setting the desired pressure.

6. The apparatus of claim 5 further comprising a bezel defining the operating range and wherein the slide operator is received in the bezel.

7. The apparatus of claim 6 wherein the slide operator and bezel have interengaging surfaces to retain the slide operator at a position within the operating range.

8. The apparatus of claim 7 wherein one of the slide operator and bezel have a resilient projection and the other of the slide operator and bezel have a corrugated surface in contact with the resilient projection.

9. The apparatus of claim 8 wherein the corrugated surface comprises a linear array of alternating hills and valleys and the resilient projection is movable between the valleys as the slide operator is moved with respect to the bezel.

10. The apparatus of claim 1 wherein the resilient means for biasing the switch comprises a spring.

11. The apparatus of claim 1 wherein the lever has a cam surface and the linear actuator has at least one cam follower surface in contact with the cam surface of the linear actuator.

12. The apparatus of claim 1 wherein the linear actuator has a first portion in contact with the lever and a second portion in contact with the switch.

13. The apparatus of claim 1 wherein the first portion of the linear actuator has a bore therethrough and the second portion of the linear actuator is a dowel pin received in the bore.

14. The apparatus of claim 13 wherein the linear actuator further comprises a setscrew and spring received in the bore and operative to urge the dowel pin out of the bore towards the switch.

15. The apparatus of claim 14 wherein the setscrew is positionable within the bore to calibrate a maximum pressure for the apparatus corresponding to an end of travel of the lever.

16. The apparatus of claim 14 wherein the first portion of the linear actuator has a non-circular cross section along at least a part thereof and the base has a mating non-circular cross section in contact therewith to prevent rotation of the linear actuator about the axis when the setscrew is threaded into and out of the bore.

17. The apparatus of claim 1 further comprising f. a pressure sensor; and wherein the base further includes a reference surface for receiving and positively locating the pressure sensor with respect to the switch.

* * * * *